US012760532B2

(12) United States Patent
Repasky

(10) Patent No.: US 12,760,532 B2
(45) Date of Patent: Oct. 13, 2026

(54) LOCKING MECHANISM PEDESTAL ASSEMBLY

(71) Applicant: Hanover Prest-Paving Company, Hanover, PA (US)

(72) Inventor: Kevin Repasky, Hanover, PA (US)

(73) Assignee: Hanover Prest-Paving Company, Hanover, PA (US)

( * ) Notice: Subject to any disclaimer, the term of this patent is extended or adjusted under 35 U.S.C. 154(b) by 64 days.

(21) Appl. No.: 18/938,709

(22) Filed: Nov. 6, 2024

(65) Prior Publication Data

US 2026/0125912 A1 May 7, 2026

(51) Int. Cl.
*E04F 15/024* (2006.01)

(52) U.S. Cl.
CPC ..... *E04F 15/02447* (2013.01)

(58) Field of Classification Search
CPC ..... E04F 15/02447; E04F 15/02452
See application file for complete search history.

(56) References Cited

U.S. PATENT DOCUMENTS 6,332,292 B1 * 12/2001 Buzon ..... E04F 15/02183 248/351
9,499,992 B2 * 11/2016 Busby ..... E04F 15/02044
2002/0121583 A1 * 9/2002 Jones ..... E01C 5/223 248/188
2008/0222973 A1 * 9/2008 Lee ..... E04F 15/02488 52/126.6
2017/0260699 A1 * 9/2017 Tabibnia ..... F24D 3/122
2022/0025586 A1 1/2022 Repasky et al.
2023/0374794 A1 * 11/2023 Repasky ..... E04F 15/02458
2025/0034884 A1 * 1/2025 Lynch ..... E04F 15/02452
2026/0028831 A1 * 1/2026 Repasky ..... E04F 15/02458

FOREIGN PATENT DOCUMENTS

CN 116122535 A 5/2023
WO 2018044158 A1 3/2018

OTHER PUBLICATIONS

European Patent Office Extended Search Report dated Apr. 13, 2026, corresponding to Application No. 25210695.0-1005, 12 pages.

* cited by examiner

*Primary Examiner* — Daniel J Rohrhoff
(74) *Attorney, Agent, or Firm* — Barley Snyder

(57) ABSTRACT

A locking mechanism pedestal assembly includes a support mechanism. The locking mechanism pedestal assembly further includes a locking mechanism positioned within the support mechanism. The locking mechanism pedestal assembly includes an insert assembly positioned through the support mechanism and the locking mechanism. The locking mechanism pedestal assembly includes a pedestal, the support mechanism and the locking mechanism abut against a top of the pedestal.

16 Claims, 44 Drawing Sheets

LOCKING MECHANISM PEDESTAL ASSEMBLY

FIELD OF THE INVENTION

The present invention pertains to a locking mechanism pedestal assembly and, more particularly, for a support member.

BACKGROUND

Pavers, tiles, or other floor panels, referred to hereinafter simply as pavers, are used in a variety of architectural and landscape settings. Sometimes pavers are installed in gardens, patios, walkways, driveways, or on the roofs of buildings. Some types of pavers are made from heavy materials and have physically large dimensions, making them resistant to movement after installation. Such is the case, when pavers are used for landscaping, sidewalks, patios and driveways. In other applications, pavers have less weight, limiting the load on the surface over which they are installed. In some cases, access to an object that is underneath the installed paver is required. In this type of installation, the paver may be elevated from an installed surface and have access channels or pathways underneath. In installations, such as this, the paver maybe lightweight and form an elevated walkway. In the case of an elevated installation, the pavers may become airborne and dislodged in a high wind condition.

What is needed is a paver supporting apparatus that provides reduced surface load, ease of access to under paver objects, while preventing pavers from becoming dislodged from an elevated installed surface in a high wind condition.

SUMMARY

A locking mechanism pedestal assembly includes a support mechanism. The locking mechanism pedestal assembly further includes a locking mechanism positioned within the support mechanism. The locking mechanism pedestal assembly includes an insert assembly positioned through the support mechanism and the locking mechanism. The locking mechanism pedestal assembly includes a pedestal, the support mechanism and the locking mechanism abut against a top of the pedestal.

BRIEF DESCRIPTION OF DRAWINGS

In the following, the present invention is described in more detail with references to the drawings in which.

DETAILED DESCRIPTION OF THE EMBODIMENTS

Figure 1:
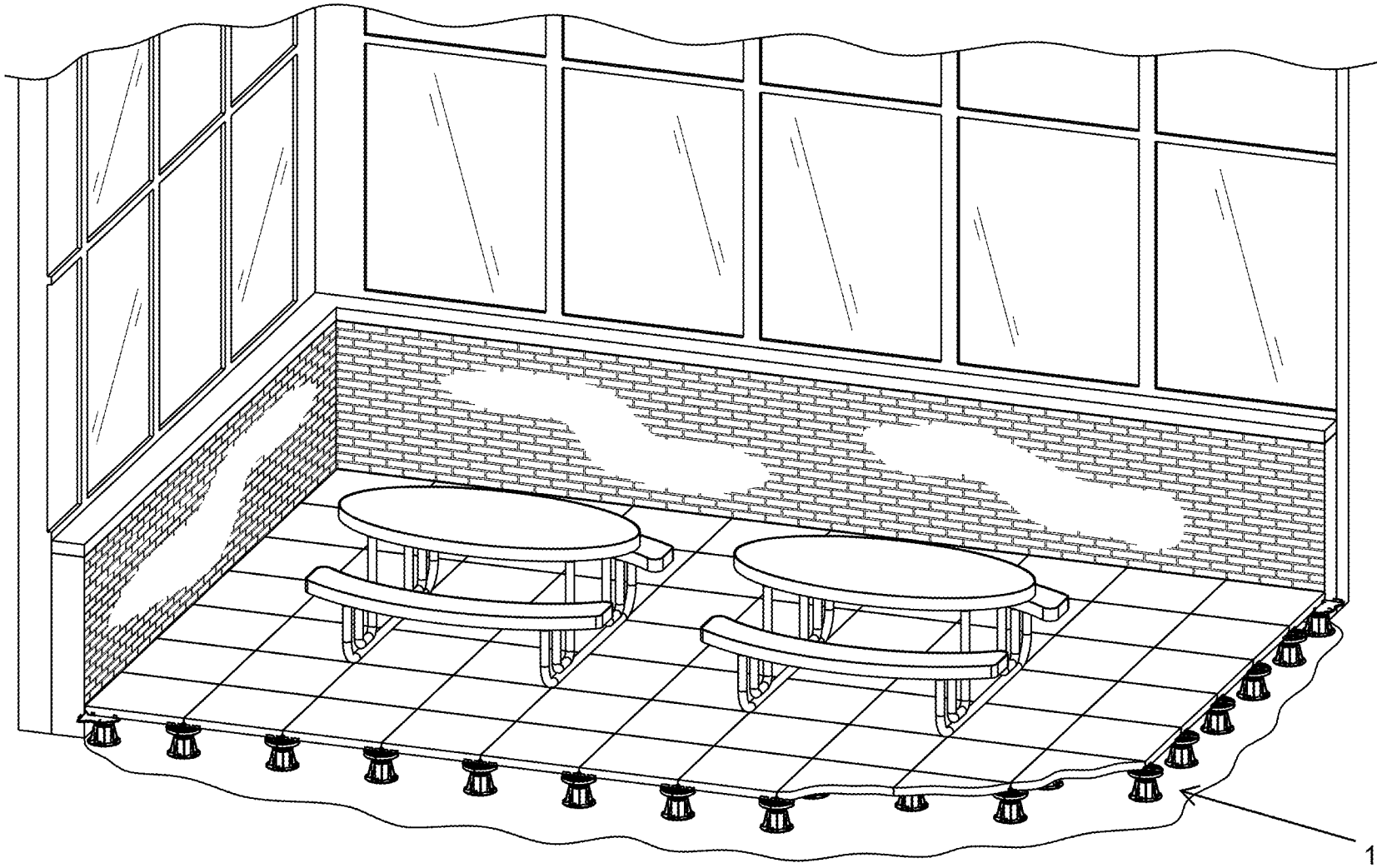
FIG. 1 illustrates a perspective view of the locking mechanism pedestal assembly.

With reference to the Figures, a locking mechanism assembly 1 according to the invention is shown. In an exemplary embodiment shown, a locking mechanism assembly 1 according to the invention generally includes an insert assembly 2 and a locking assembly 4.

In the exemplary embodiment, the insert assembly 2 generally includes a top insert 10 and a bottom insert 50.

Figure 2:
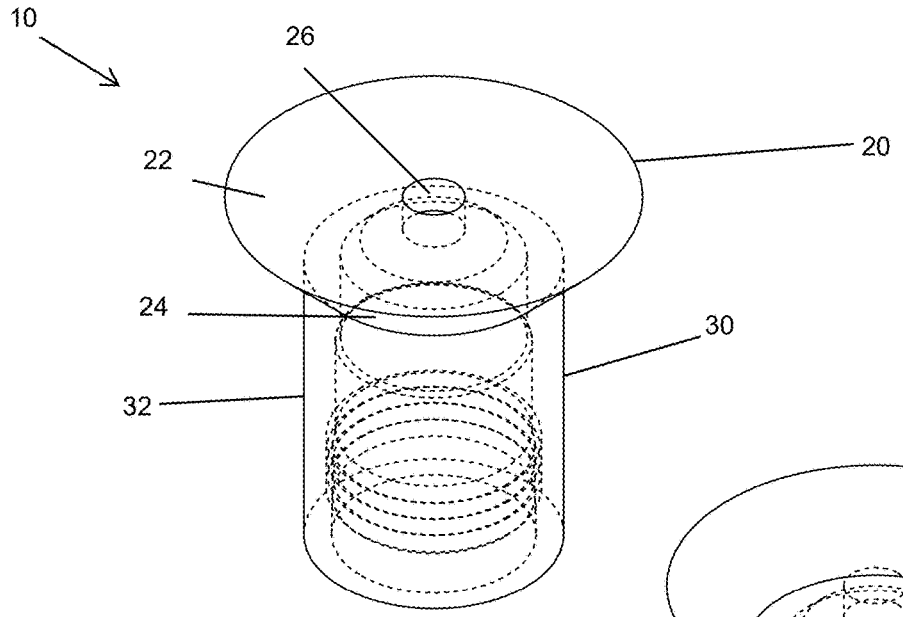
FIG. 2 illustrates a front, top, right side perspective view of a portion of the invention.
Figure 3:
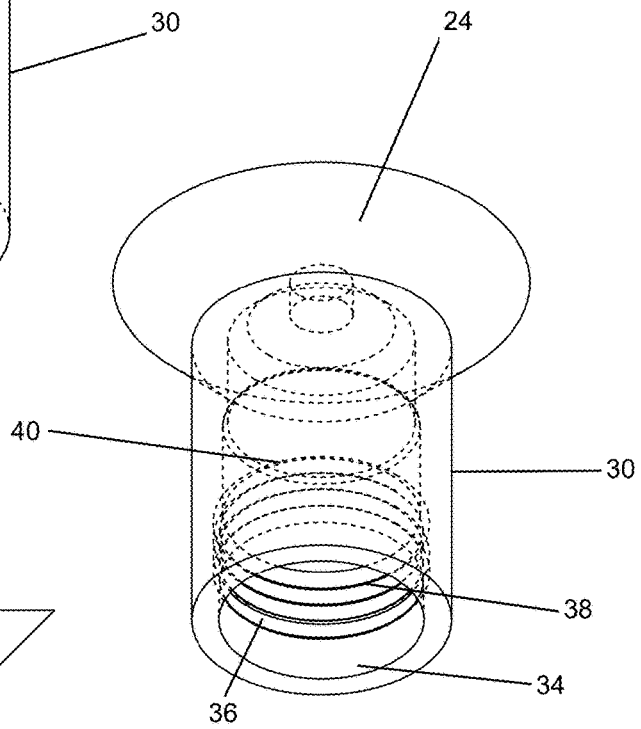
FIG. 3 illustrates a rear, bottom, left side perspective view of the invention of FIG. 2.
Figure 4:
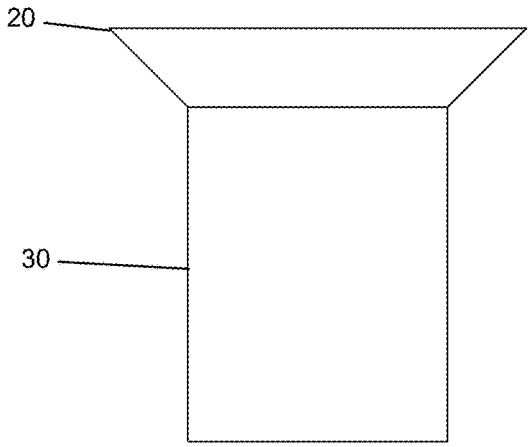
FIG. 4 illustrates a right side perspective view of the invention of FIG. 3.
Figure 5:
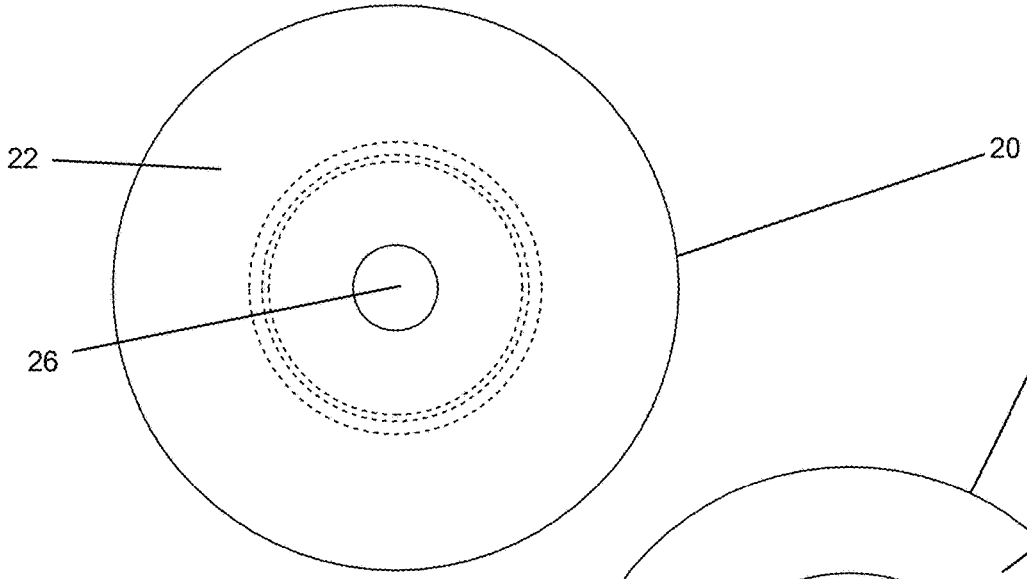
FIG. 5 illustrates a top perspective view of the invention of FIG. 4.
Figure 6:
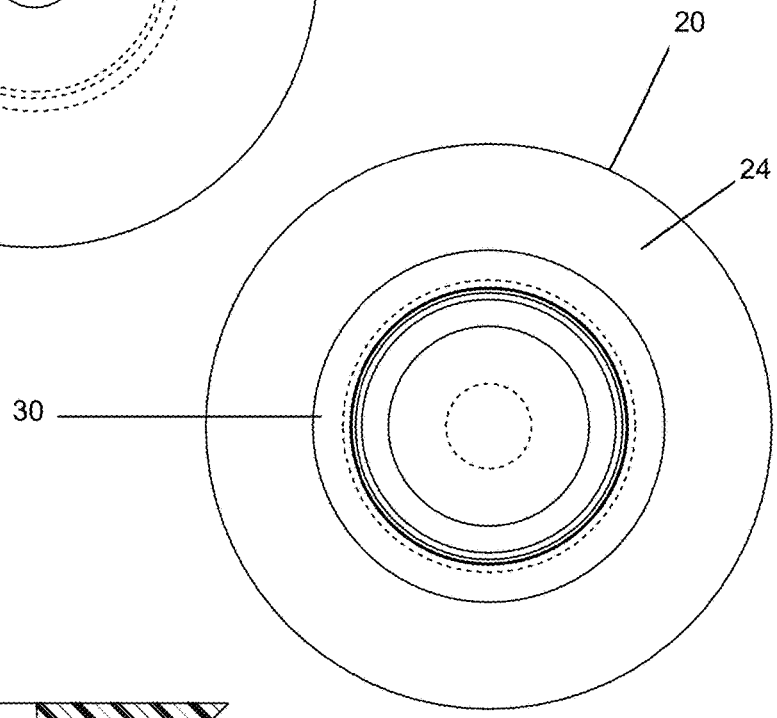
FIG. 6 illustrates a bottom perspective view of the invention of FIG. 5.
Figure 7:
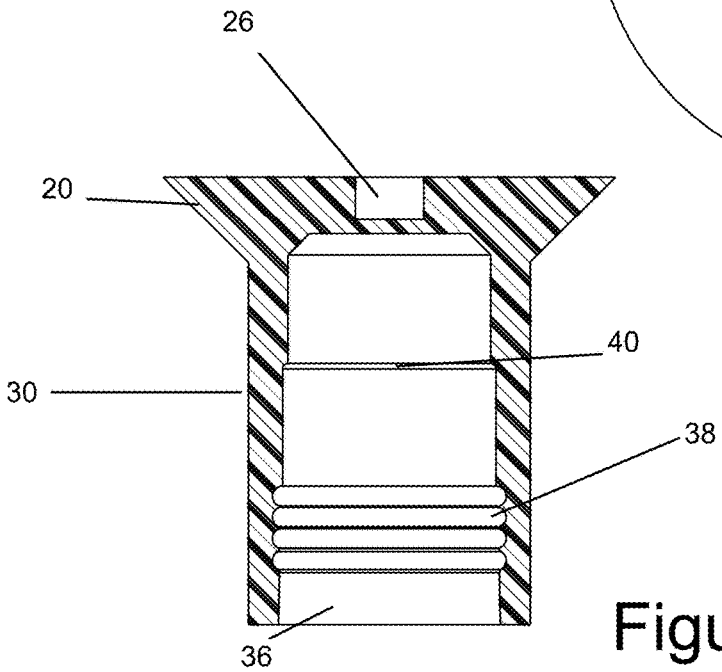
FIG. 7 illustrates a cross-sectional perspective view of the invention of FIG. 6.

As shown in FIGS. 2-7, the top insert 10 includes a head portion 20 and a neck portion 30.

In the exemplary embodiment, the head portion 20 is a circular disk. The circular disk tapers towards the neck portion 30. The head portion 20 includes an outer surface 22 and an inner surface 24. The head portion 20 further includes an indent 26 in a central region of the head portion 20. One skilled in art would understand the applicant's design is not the exclusive embodiment.

In the exemplary embodiment, the neck portion 30 is an elongated cylindrical member fixed to the inner surface 24 of the head portion 20. One skilled in the art would understand the applicant's design is not the exclusive embodiment. The neck portion 30 further includes an outer surface 32 and an inner surface 34. The inner surface 34 includes a plurality of ridges 36. Each ridge 38 of the plurality of ridges 36 is a circular ring protruding towards the outer surface 32. In the exemplary embodiment, the plurality of ridges 36 include four ridges 38 closely abutting against the previous ridge 36. One skilled in the art would understand the applicant's design is not the exclusive embodiment.

In the exemplary embodiment, the neck portion 30 further includes a ledge 40. The ledge 40 is a circular extension protruding into the inner surface 34 of the neck portion 30. One skilled in the art would understand the applicant's design is not the exclusive embodiment.

Figure 8:
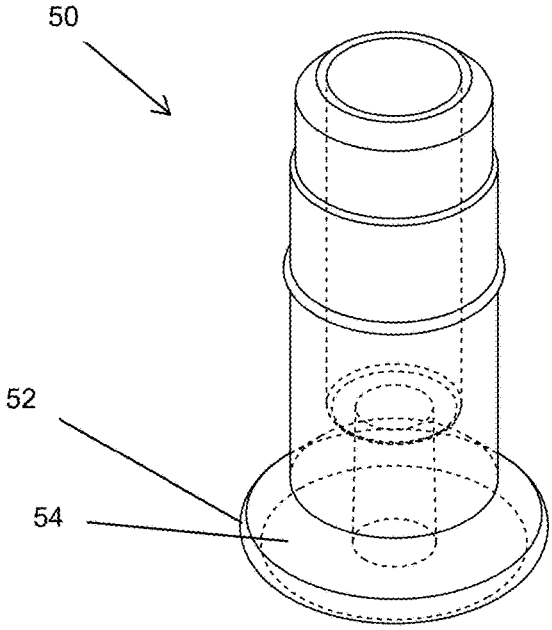
FIG. 8 illustrates a front, top, right side perspective view of a portion of the invention.
Figure 9:
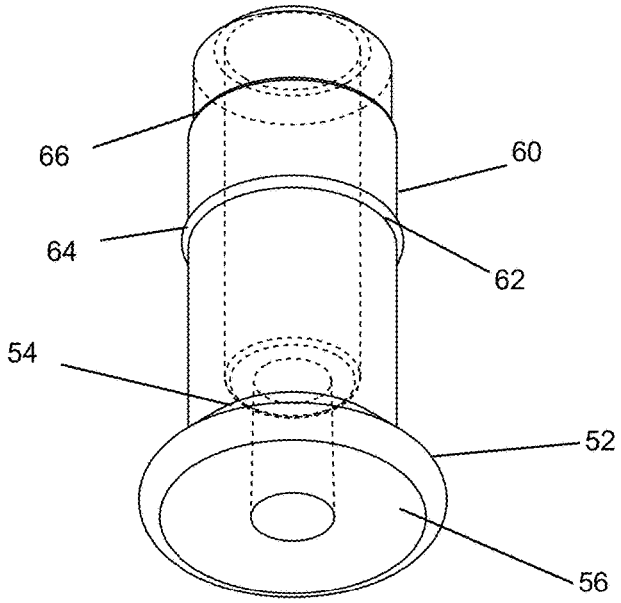
FIG. 9 illustrates a rear, bottom, left side perspective view of the invention of FIG. 8.
Figure 10:
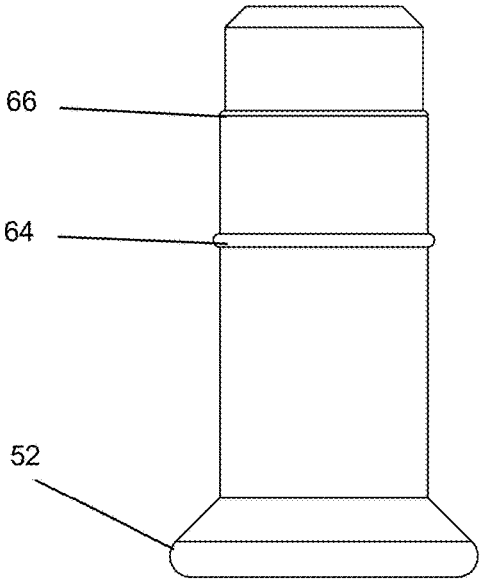
FIG. 10 illustrates a right side perspective view of the invention of FIG. 9.
Figure 11:
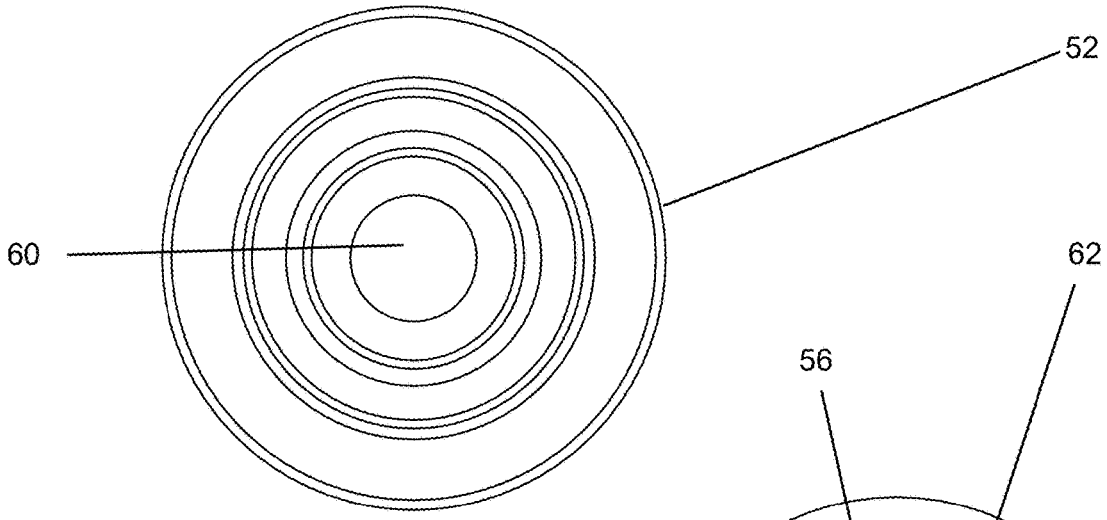
FIG. 11 illustrates a top perspective view of the invention of FIG. 10.
Figure 12:
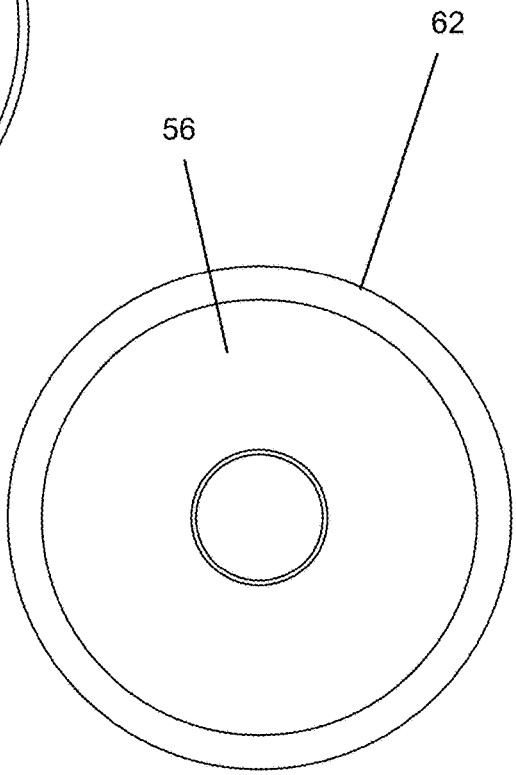
FIG. 12 illustrates a bottom perspective view of the invention of FIG. 11.
Figure 13:
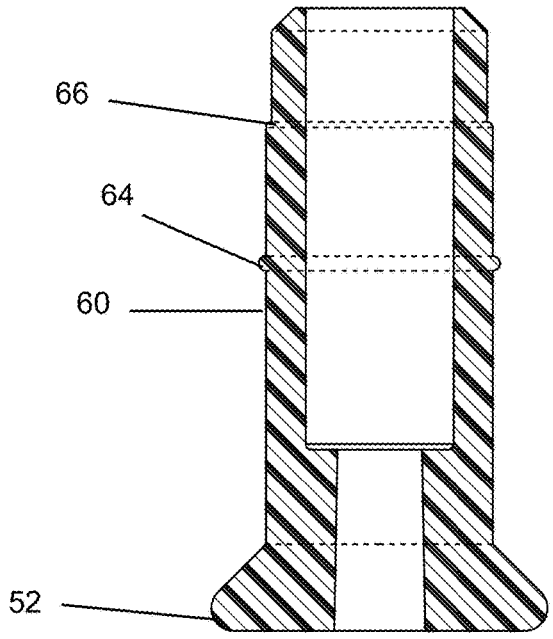
FIG. 13 illustrates a cross-sectional view of the invention of FIG. 12.

In the exemplary embodiment and as shown in FIGS. 8-13, the bottom insert 50 includes a base portion 52 and a keyed portion 60.

In the exemplary embodiment, the base portion 52 is a circular bowl shaped disk tapering towards the keyed portion 60. The base portion 52 further includes an outer surface 54 and an inner surface 56.

In the exemplary embodiment, the keyed portion 60 is an elongated cylindrical member, specifically, the keyed portion 60 is an extension tapering away from the base portion 52. One skilled in the art would understand the applicant's design is not the exclusive embodiment.

In the exemplary embodiment, the keyed portion 60 includes a plurality of ribs 62. The plurality of ribs 62 include a first rib 64 and a second rib 66. The first rib 64 is a circular ring protruding away from the keyed portion 60. The second rib 66 is a smaller circular ring protruding away from the keyed portion 60, the second rib 66 has a circumference less than a circumference of the first rib 64.

Figure 14:
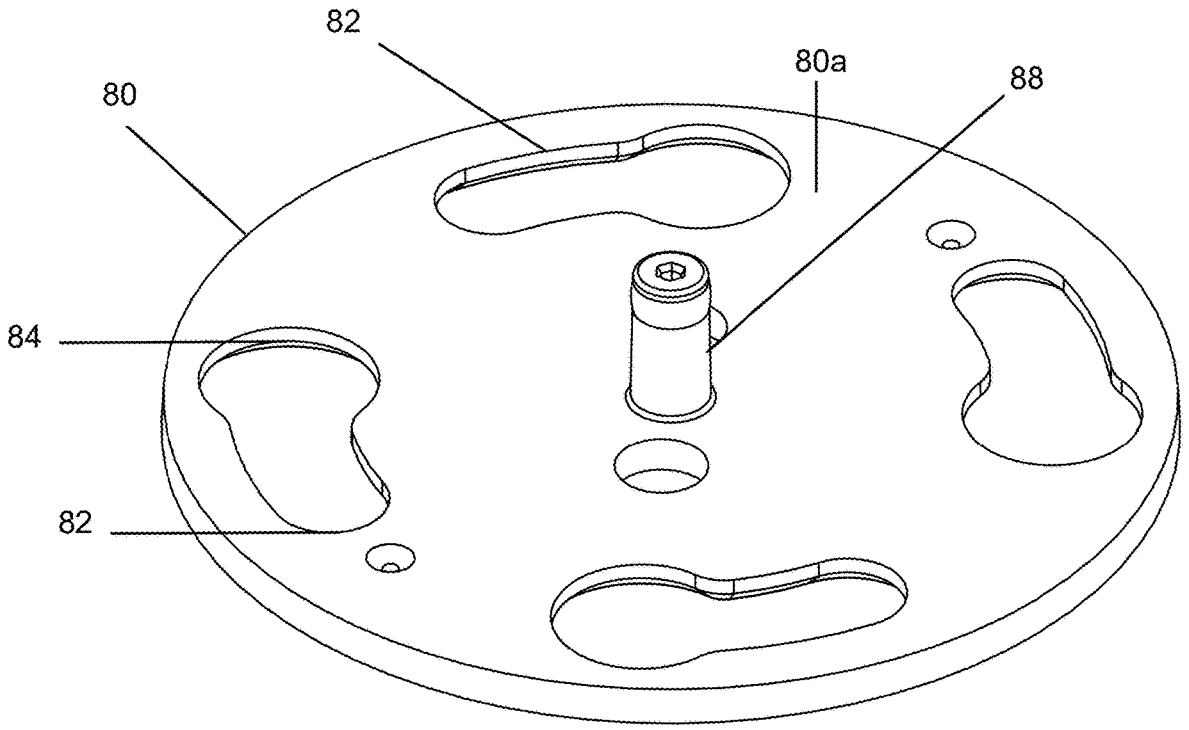
FIG. 14 illustrates a front, top, right side perspective view of a portion of the invention.
Figure 15:
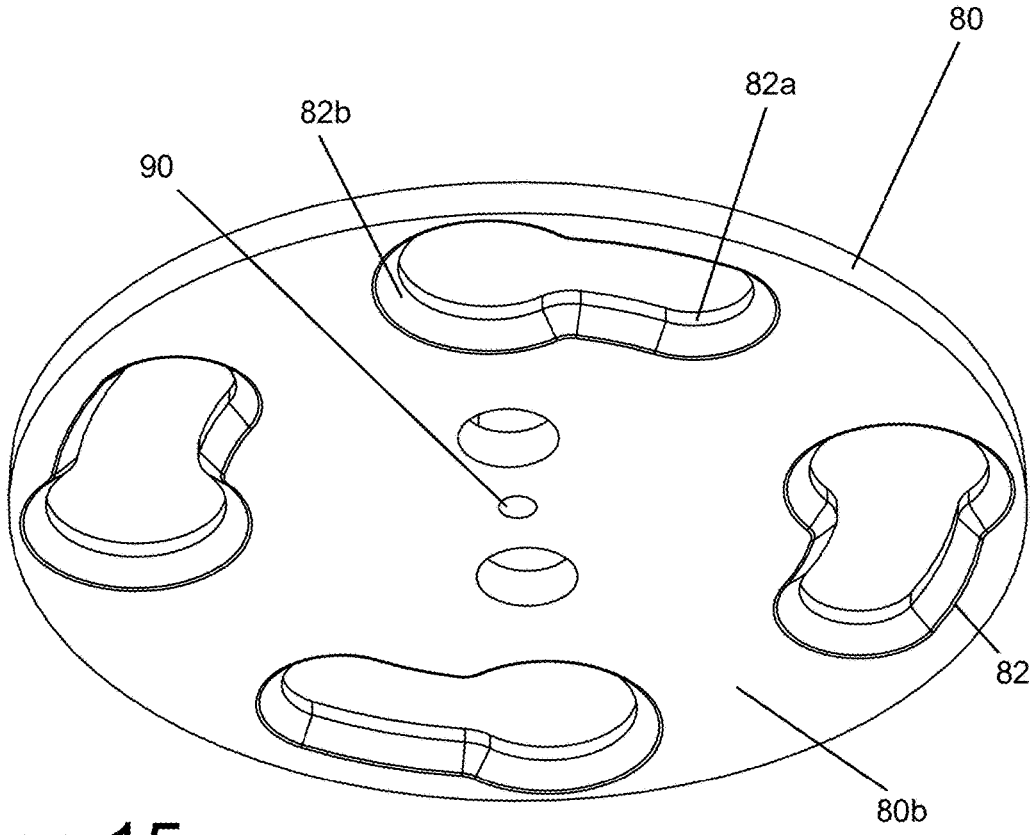
FIG. 15 illustrates a rear, bottom, left side perspective view of the invention of FIG. 14.
Figure 16:
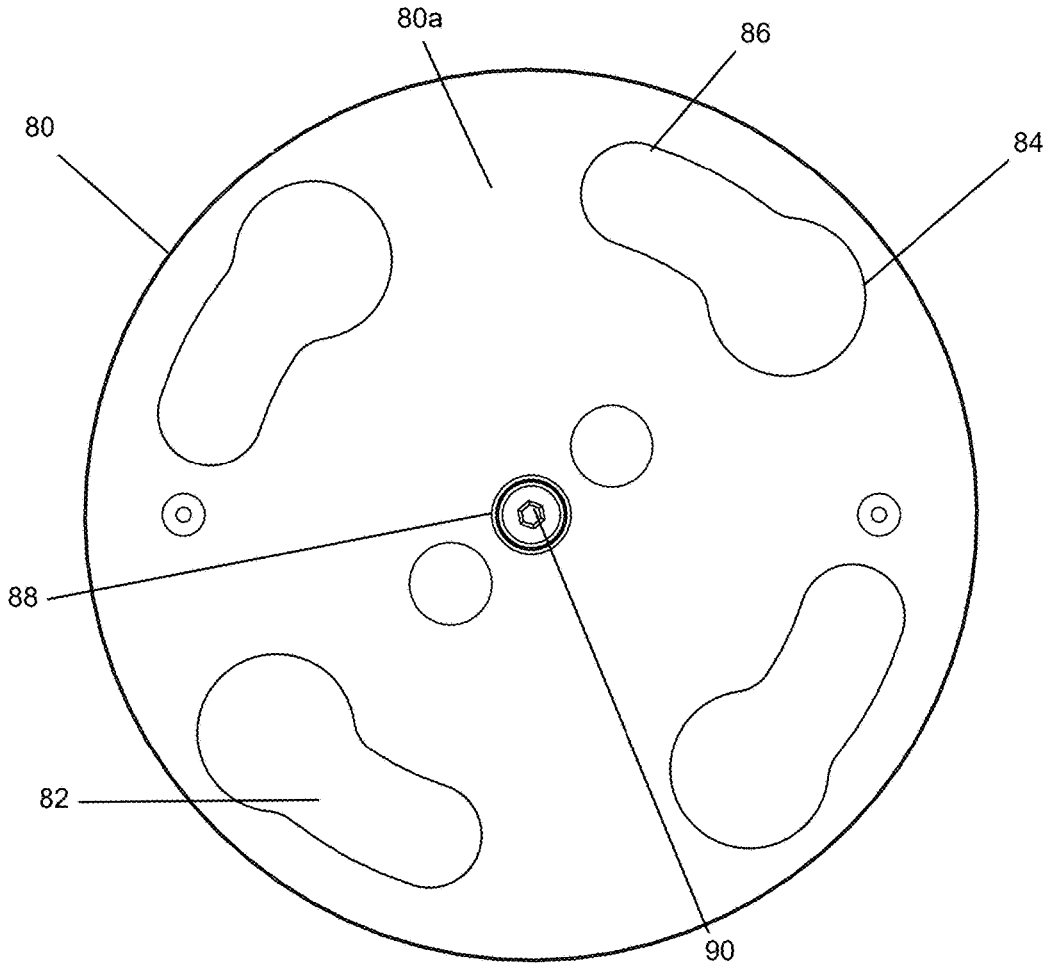
FIG. 16 illustrates a top side perspective view of the invention of FIG. 15.
Figure 17:
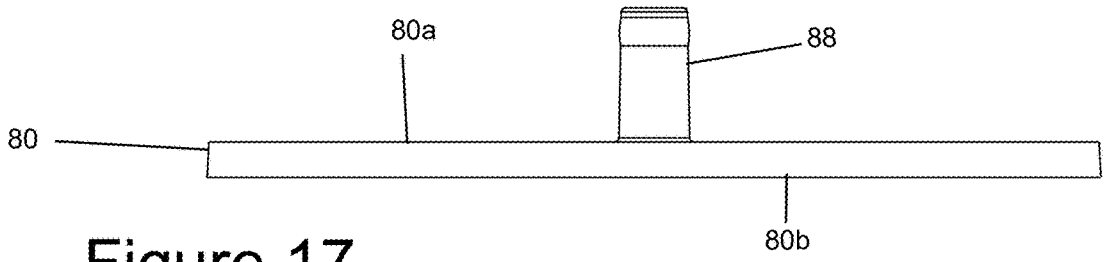
FIG. 17 illustrates a right side perspective view of the invention of FIG. 16.
Figure 18:
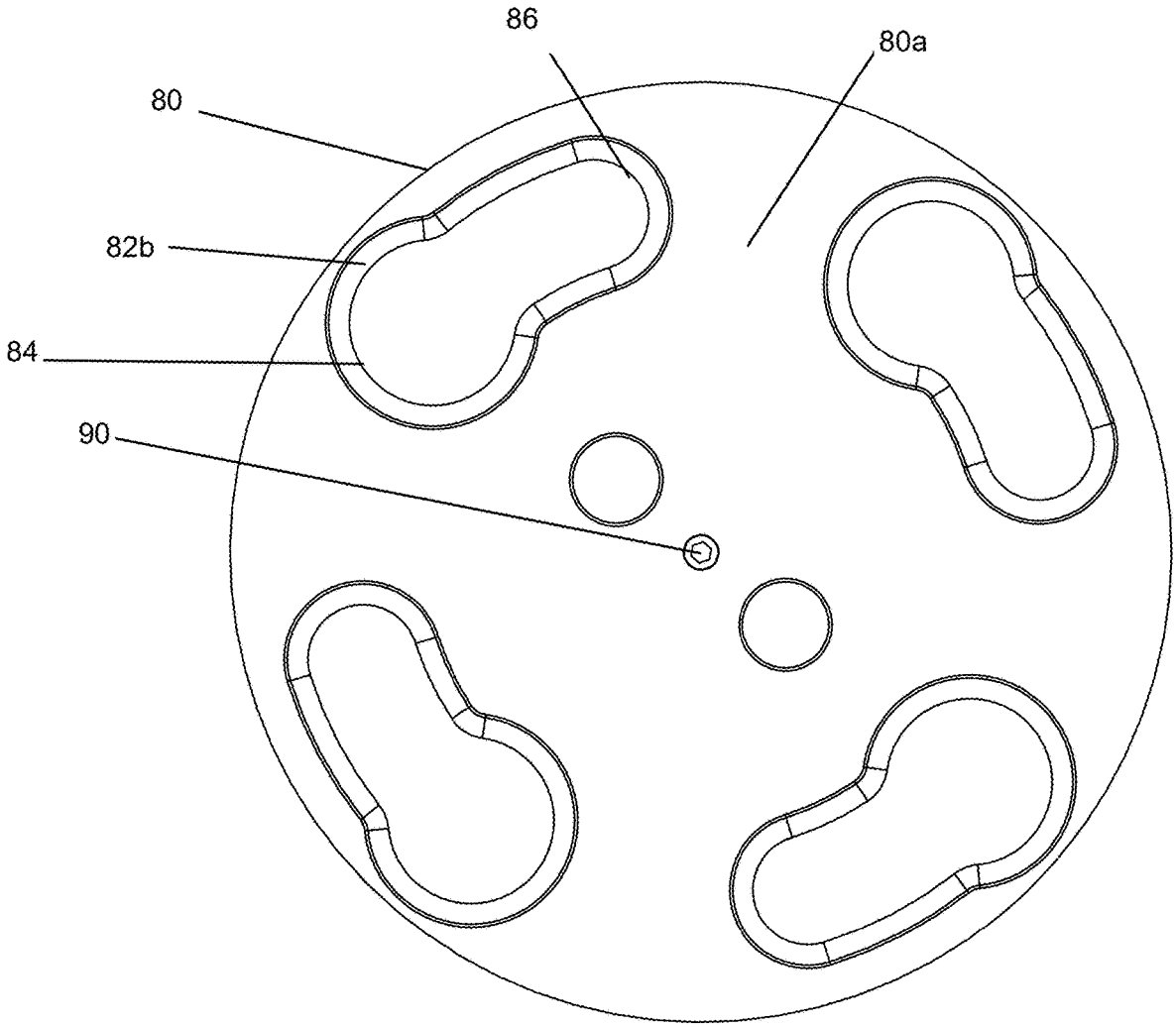
FIG. 18 illustrates a bottom perspective view of the invention of FIG. 17.
Figure 19:
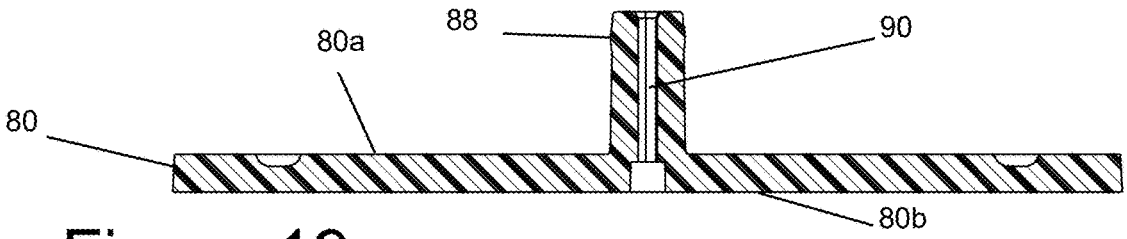
FIG. 19 illustrates a cross-sectional perspective view of the invention of FIG. 18.
Figure 20:
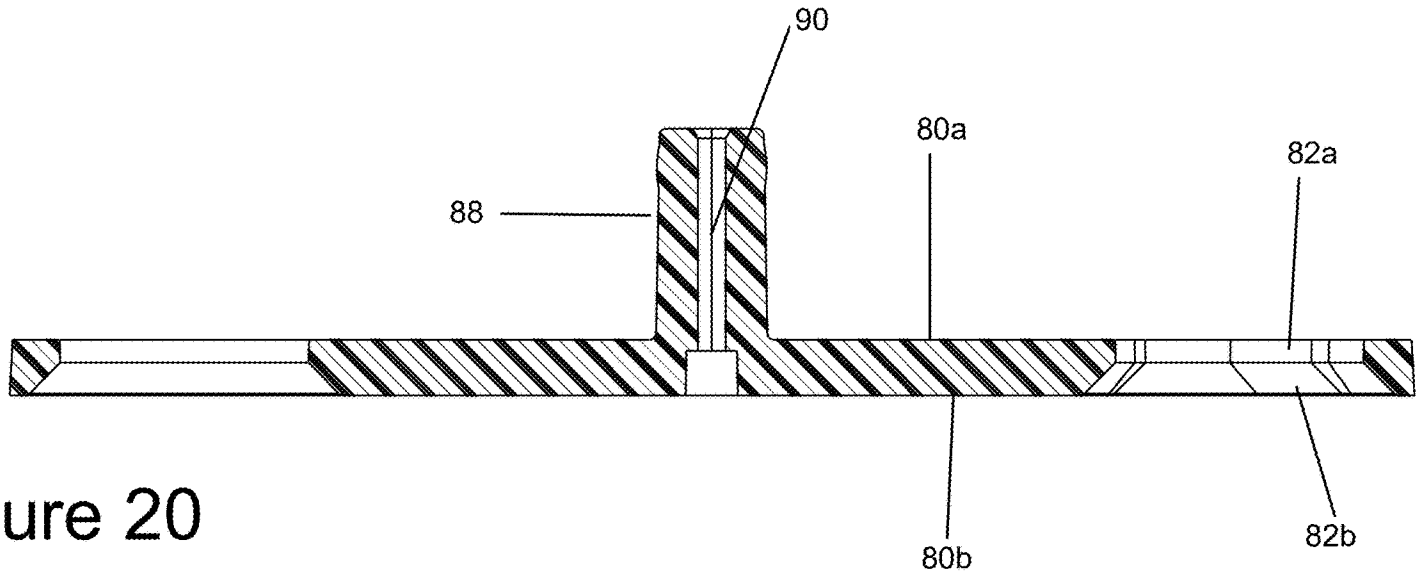
FIG. 20 illustrates another cross-sectional perspective view.
Figure 21:
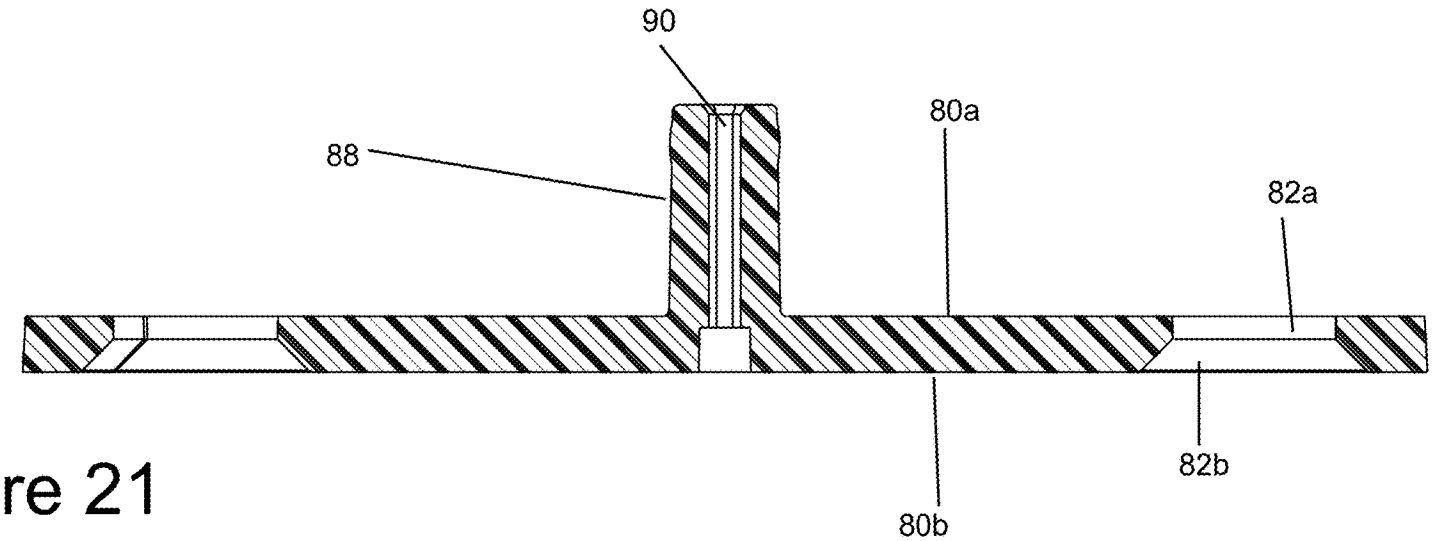
FIG. 21 illustrates another cross-sectional perspective view of the invention of FIG. 20.
Figure 22:
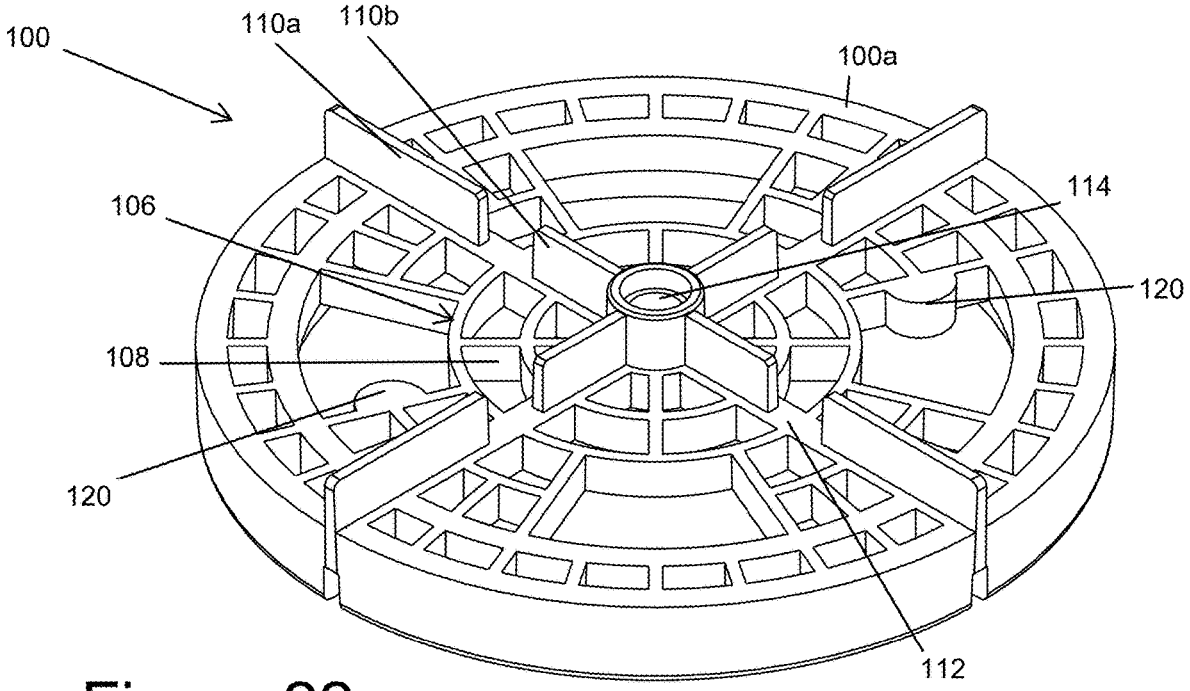
FIG. 22 illustrates a front, top, right side perspective view of the invention.
Figure 23:
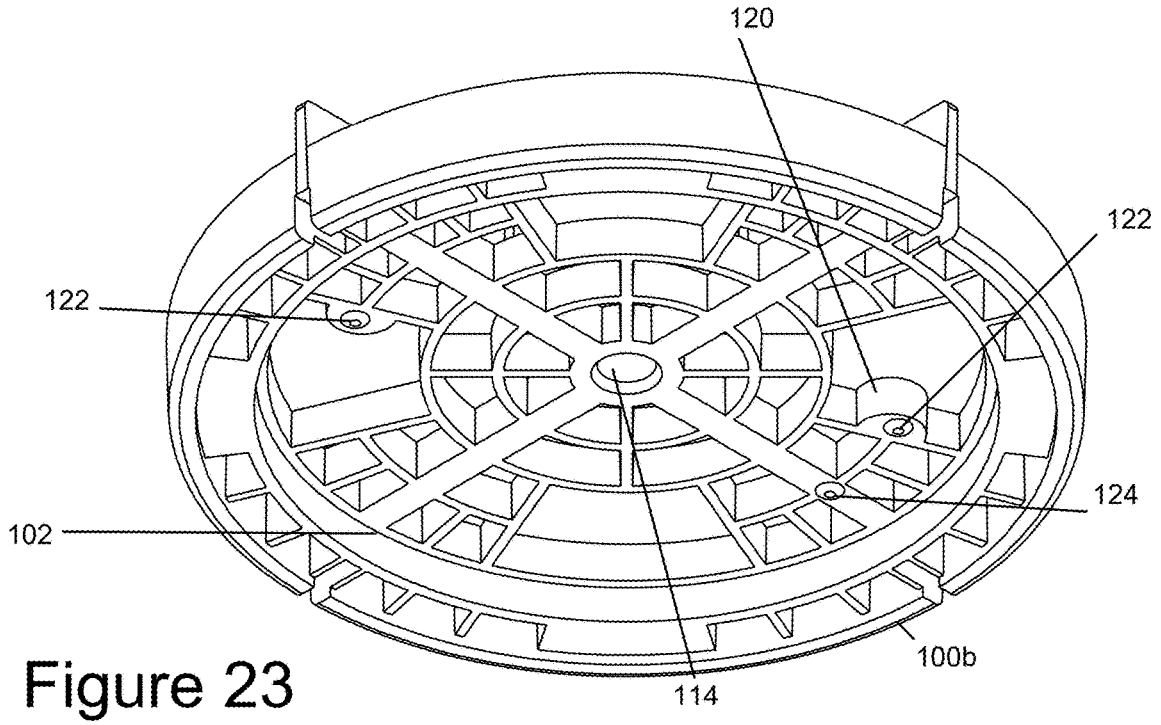
FIG. 23 illustrates a rear, bottom, left side perspective view of the invention of FIG. 22.
Figure 24:
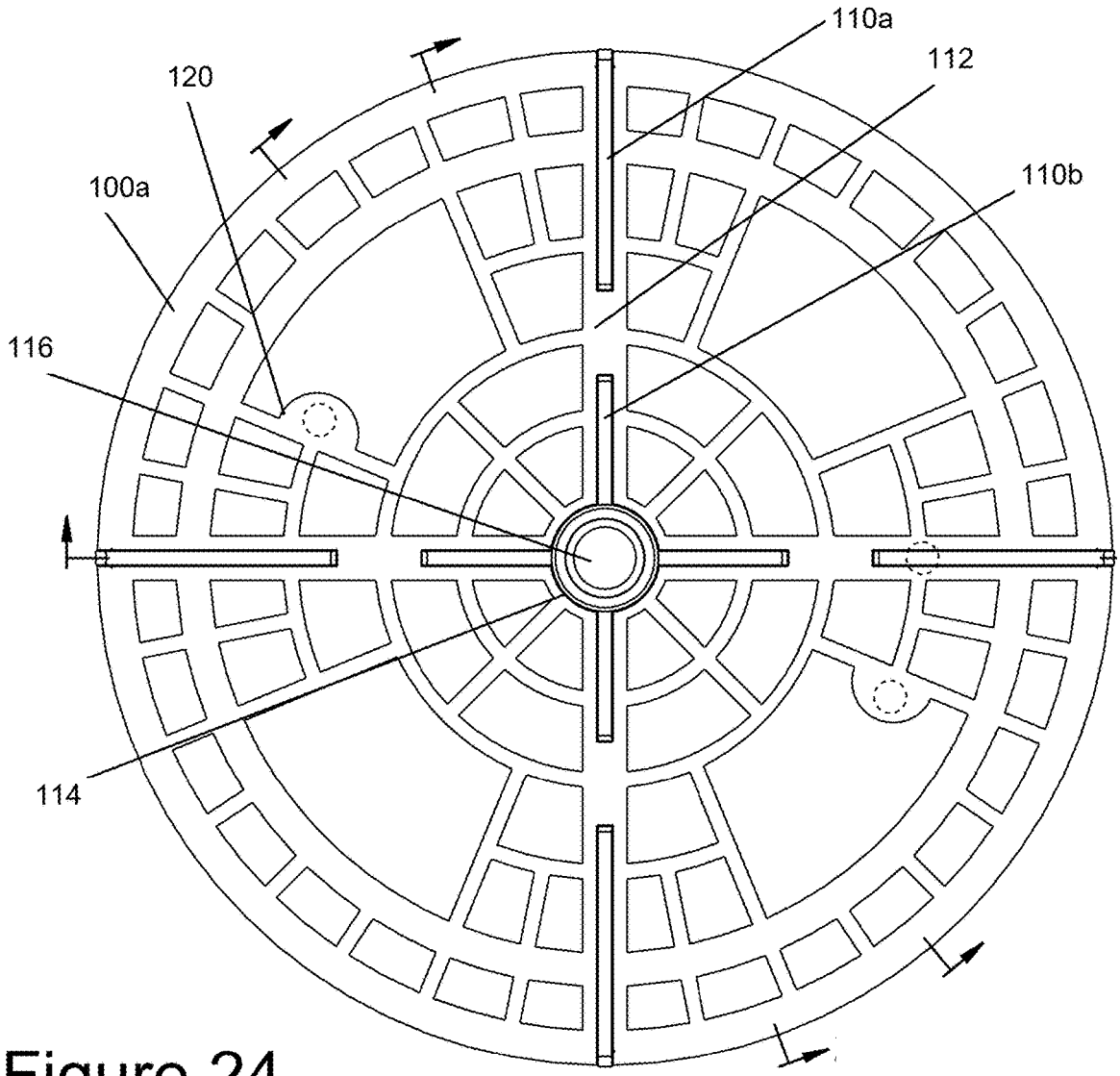
FIG. 24 illustrates a top side perspective view of the invention.
Figure 25:
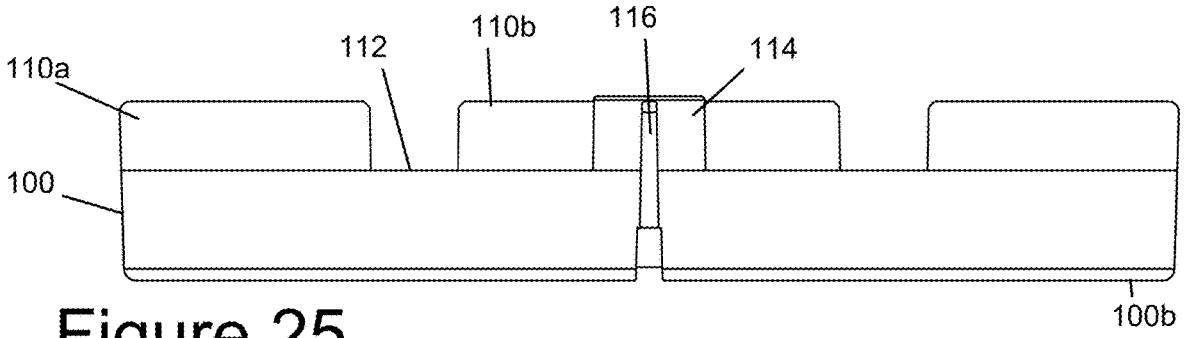
FIG. 25 illustrates a right side perspective view of the invention of FIG. 24.
Figure 26:
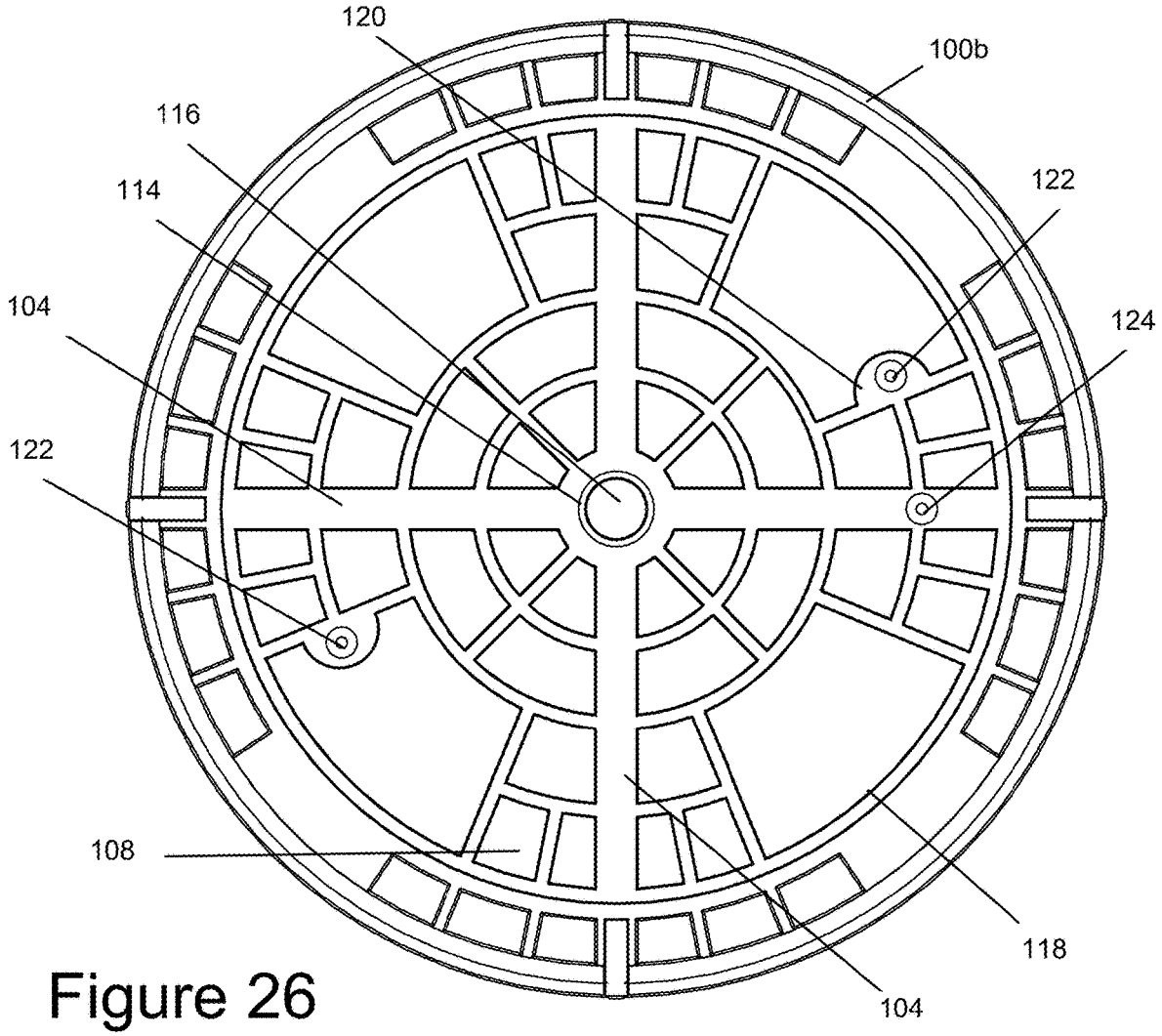
FIG. 26 illustrates a bottom side perspective view of the invention of FIG. 25.
Figure 27:
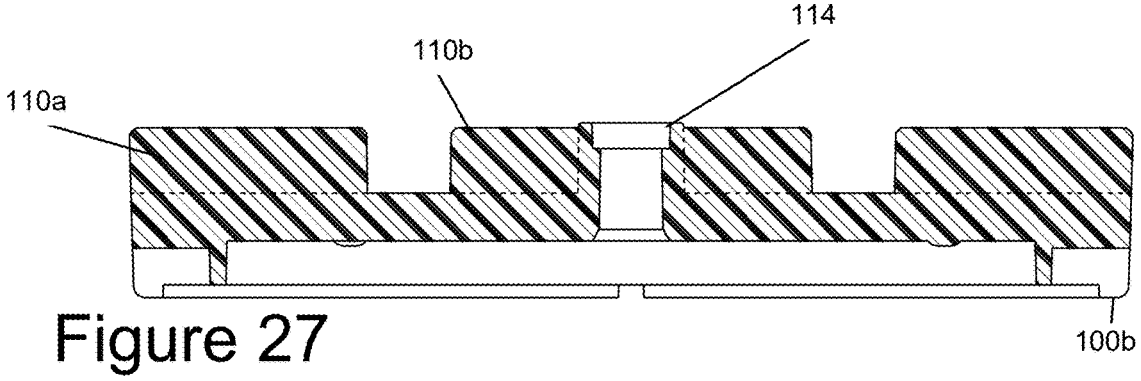
FIG. 27 illustrates a cross-sectional view of the invention of FIG. 26.
Figure 28:
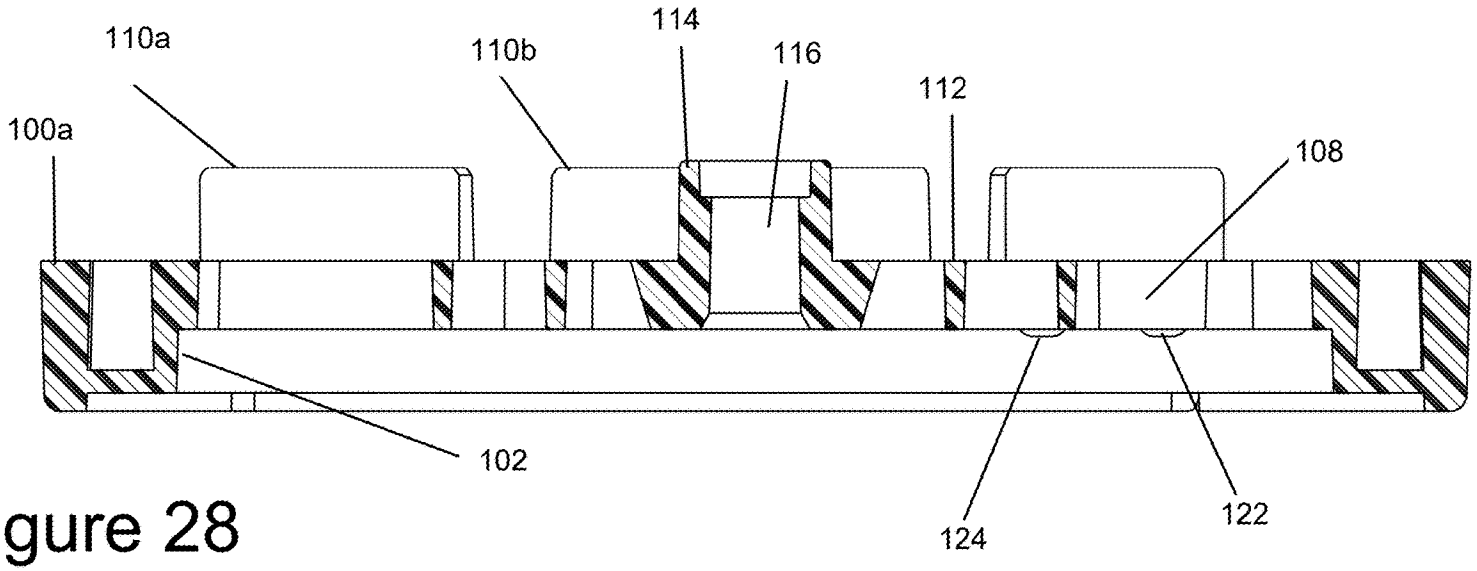
FIG. 28 illustrates a cross-sectional view another cross-sectional view.
Figure 29:
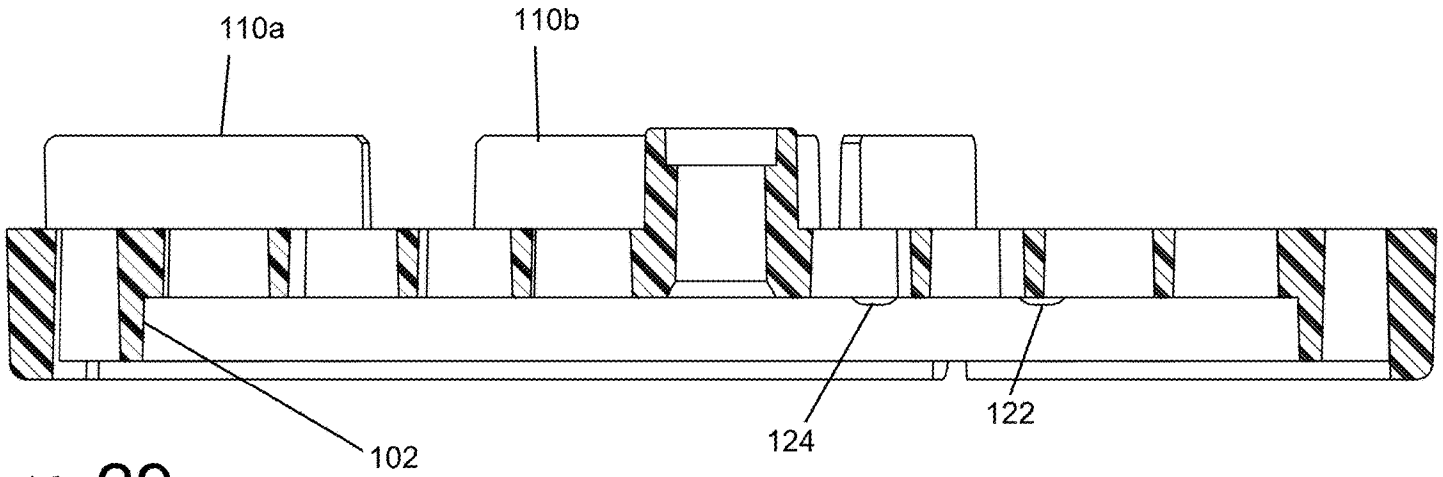
FIG. 29 illustrates another cross-sectional view of the invention of FIG. 28.

In the exemplary embodiment and as shown in FIGS. 14-29, the locking assembly 4 includes a locking mechanism 80 and a support mechanism 100.

In the exemplary embodiment, the locking mechanism 80 is a circular member with a top surface 80*a* and a bottom surface 80*b*. One skilled in the art would understand the applicant's design is not the exclusive embodiment. The locking mechanism 80 includes a plurality of insert receivers 82, specifically, the at least four insert receivers 82 are positioned on a perimeter of the locking mechanism 80. Each of the insert receivers 82 extends through the locking mechanism 80.

In the exemplary embodiment, the insert receiver 82 further includes an upper portion 82*a* and a lower portion 82*b*. The upper portion 82*a* is a wall vertically extending around the insert receiver 82. The lower portion 82*b* is a wall coupled to the upper portion 82*a* and tapering away from the upper portion 82*a*.

In the exemplary embodiment, each of the insert receivers 82 includes an unlock position 84 and a lock position 86. The unlock position 84 and the lock position 86 are identified by the shape within the insert receiver 82. Specifically, the unlock position 84 is a circular wider passageway extending to the lock position 86 which is an ovular narrower passageway.

In the exemplary embodiment, the locking mechanism 80 further includes a tooling receiver 88. The tooling receiver 88 is a cylindrical member extending outwards from the top surface 80*a* of the locking mechanism 80. The tooling receiver 88 further includes a passageway 90 extending through the tooling receiver 88 and towards the bottom surface 80*b*. The passageway 90 is hexagonal shaped. One skilled in the art would understand the applicant's design is not the exclusive embodiment. The passageway 90 is keyed to mate with a locking tool T.

In the exemplary embodiment, a support mechanism 100 is a circular member with a circumference larger than the locking mechanism 80.

In the exemplary embodiment, the support mechanism 100 includes a top surface 100*a* and a bottom surface 100*b*. The support mechanism 100 further includes a receiver 102. The receiver 102 is a groove within an inner surface of a bottom surface 100*b* of the support mechanism 100.

In the exemplary embodiment, the receiver 102, mirrors the dimensions and shape of the locking mechanism 80 allowing the locking mechanism 80 to friction fit within the receiver 102. In the exemplary embodiment, the receiver 102 is a circular groove.

In the exemplary embodiment, the support mechanism 100 further includes a pair of structural beams 104. The pair of structural beams 104 each extend from one position on the perimeter of the support mechanism 100 to a second position on the perimeter of the support mechanism 100. The pair of structural beams 104 intersect.

In the exemplary embodiment, the support mechanism 100 further includes a plurality of quadrants 106, specifically four quadrants 106. The at least four quadrants 106, each include a plurality of geometric lattices 108. Additionally, each of the quadrants 106 further include a pair of walls 110. Each wall of the pair of walls 110 are each elongated members extending towards a central region of the support mechanism 100.

In the exemplary embodiment, the pair of walls 110 include an outer wall 110*a* and an inner wall 110*b*. The outer wall 110*a* has a length greater than a length of the inner wall 110*b*. The pair of walls 110 further provide a gap 112. One skilled in the art would understand the applicant's design is not the exclusive embodiment.

In the exemplary embodiment, the support mechanism 100 further includes a tooling receiver 114 extending through the central region of the support mechanism 100. The tooling receiver 114 provides the tooling device T to be inserted within a passageway 116 extending through the tooling receiver 114.

In the exemplary embodiment, the support mechanism 100 further includes a plurality of stabilizers 118. Specifically, the at least four stabilizers are each trapezoidal shaped passageways extending through the support mechanism 100. One skilled in the art would understand the applicant's design is not the exclusive embodiment.

In the exemplary embodiment, each stabilizer 118 further includes a protrusion 120. The protrusion 120 is bulb shaped and extends from a wall of the stabilizer 118, towards the central portion of the stabilizer 118.

In the exemplary embodiment, the support mechanism 100 further includes a plurality of stoppers 122. In the exemplary embodiment, there are three stoppers 122, 124. One skilled in the art would understand the applicant's design is not the exclusive embodiment. The at least two stoppers 122 is a protrusion extending away from the support mechanism 100 and positioned on a bottom surface 100*b* of the support mechanism 100. Specifically, each stopper 122 extend downwards from the protrusion 120.

In the exemplary embodiment, the support mechanism 100 includes a stopper 124 on the structural beam 104 extending downwards from the support mechanism 100.

Figure 30:
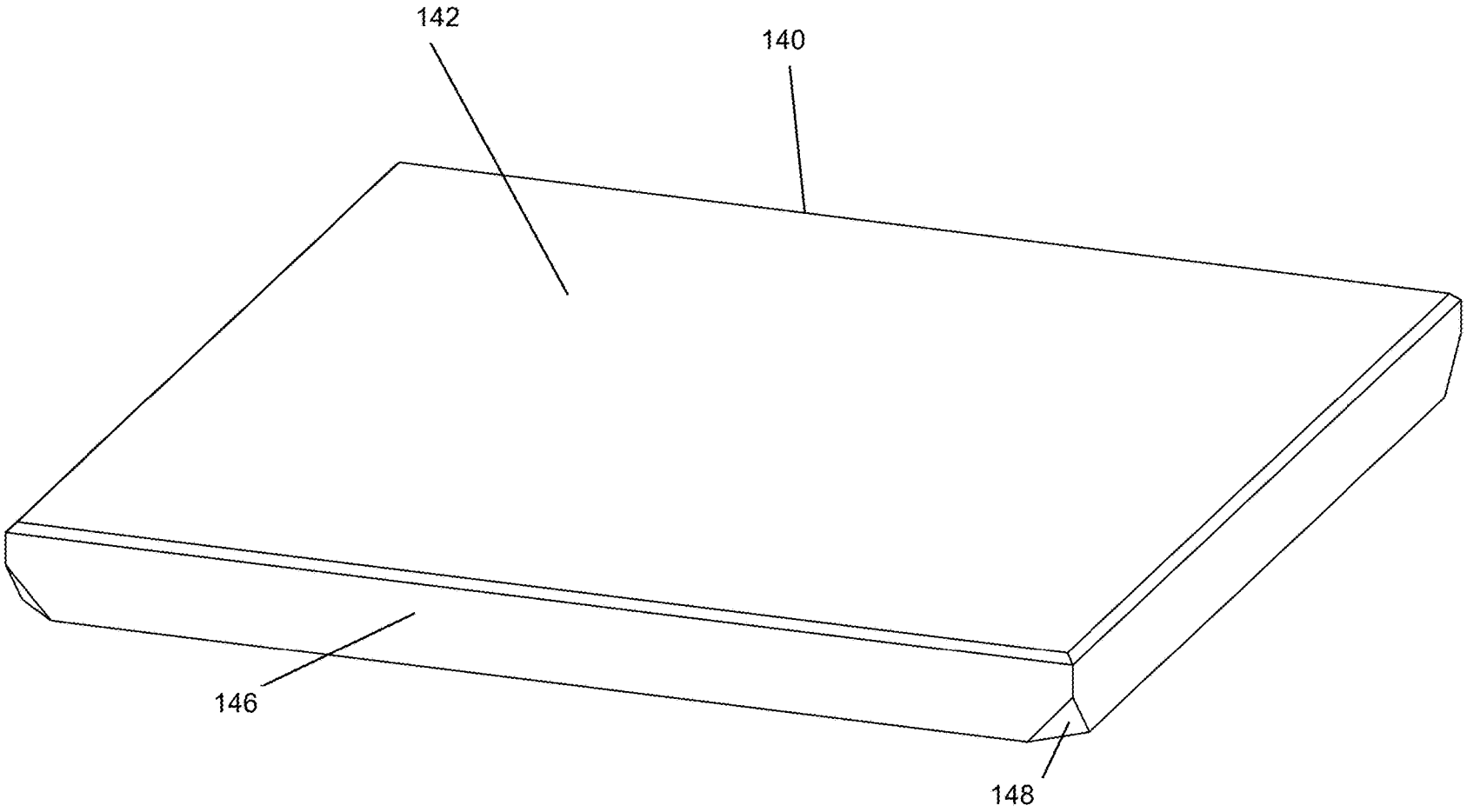
FIG. 30 illustrates a front, top, right side perspective of a portion of the invention.
Figure 31:
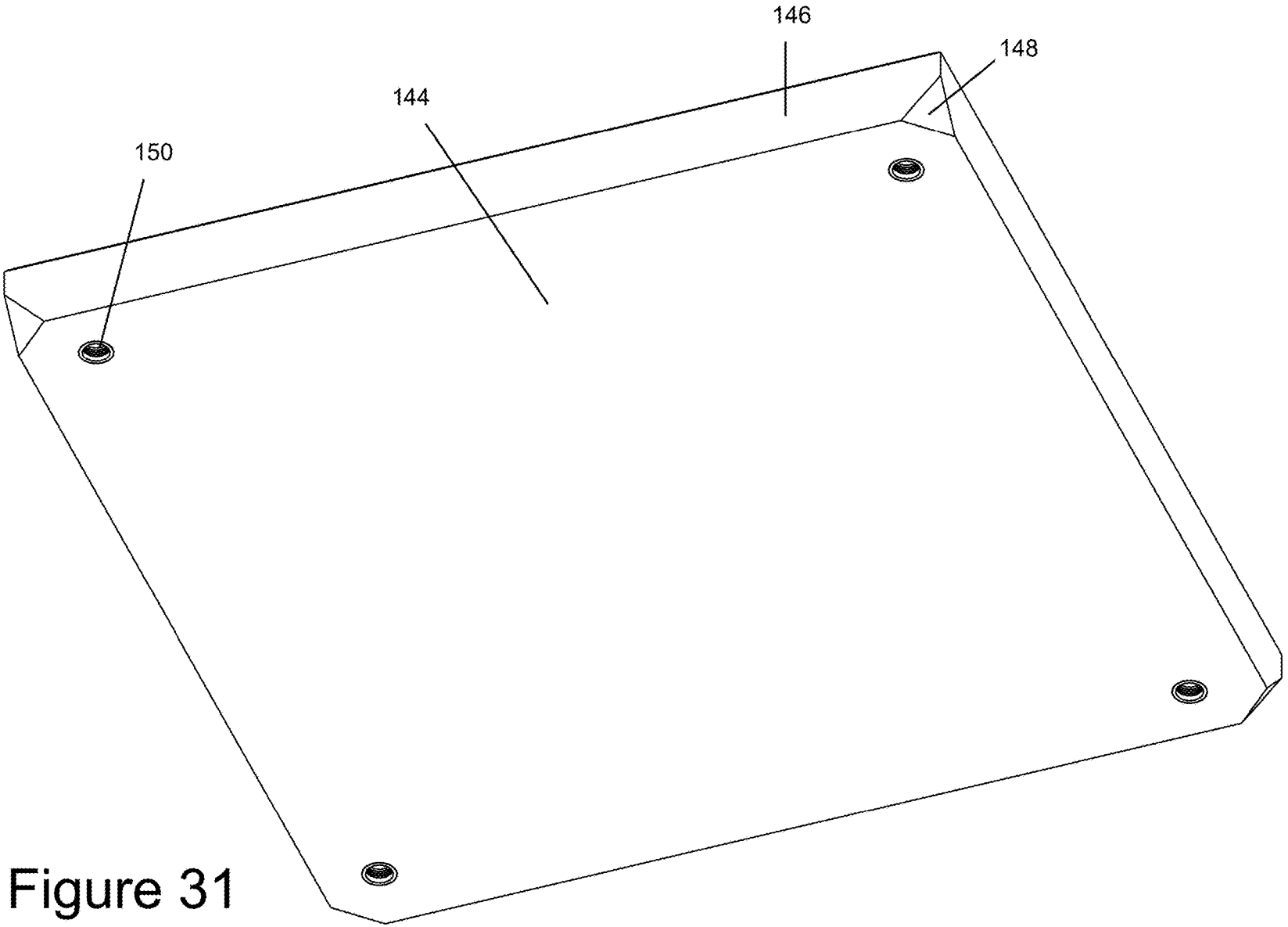
FIG. 31 illustrates a rear, bottom, left side perspective view of the invention of FIG. 30.
Figure 32:
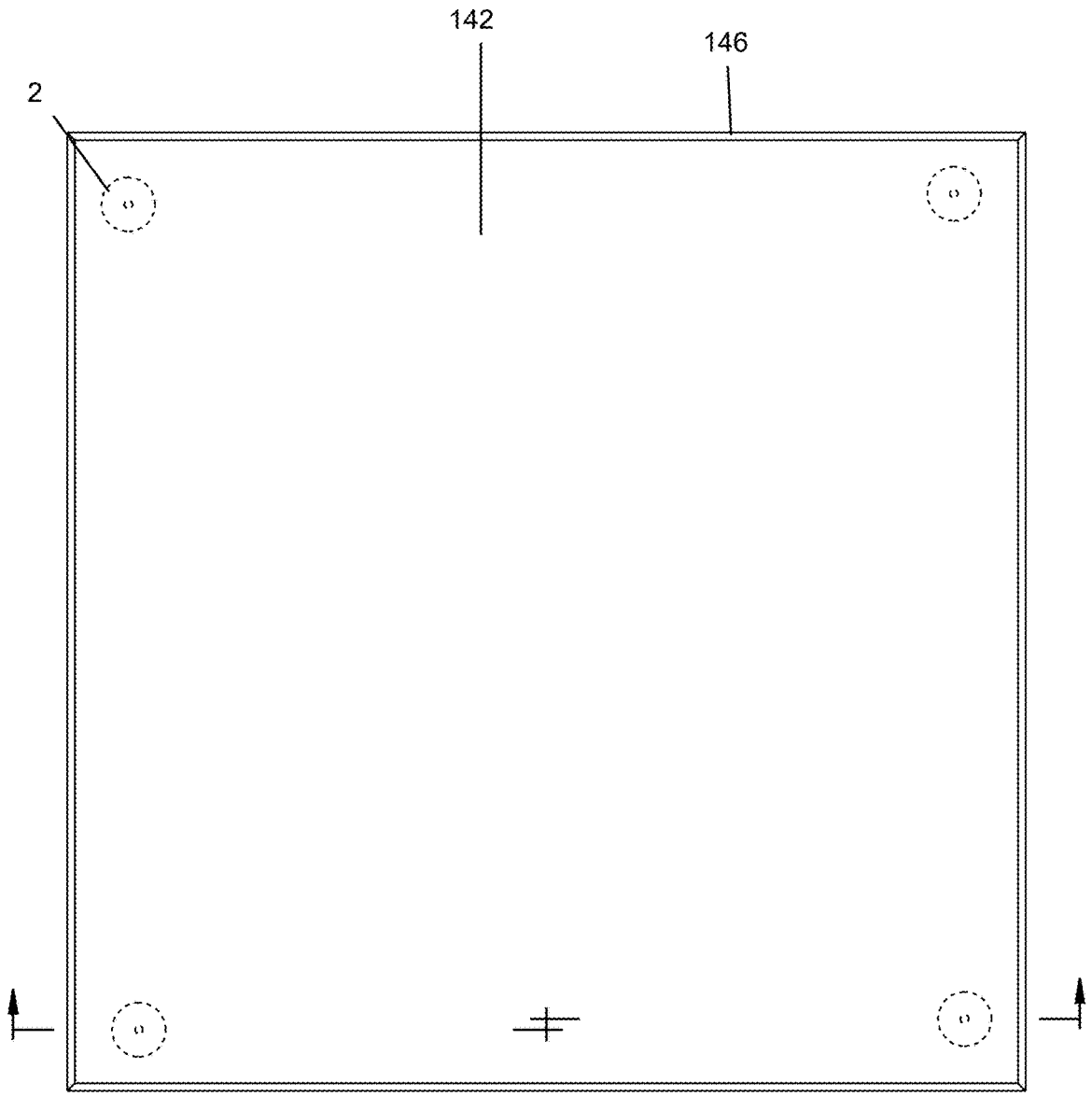
FIG. 32 illustrates a top side perspective of the invention of FIG. 31.
Figure 33:
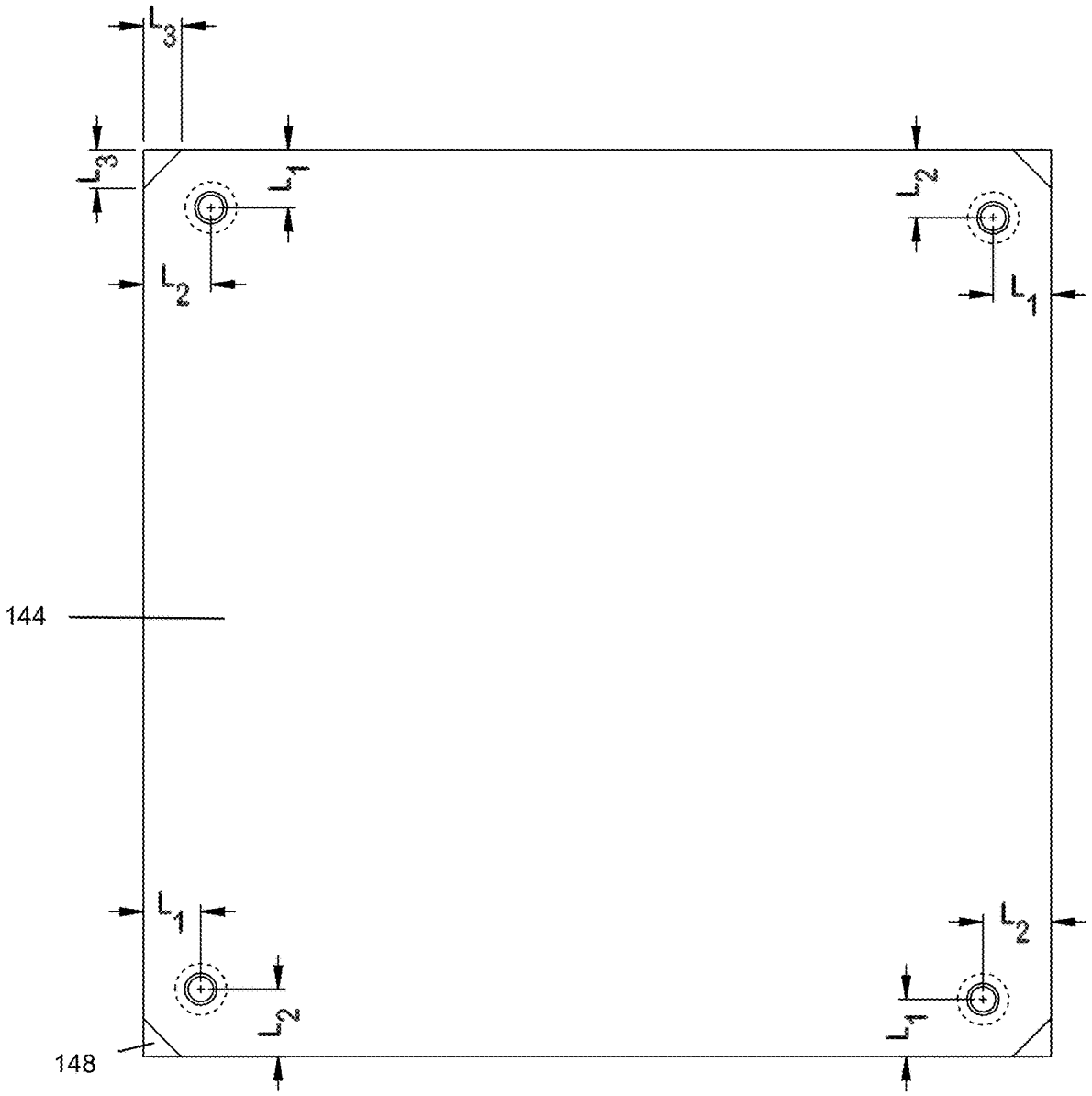
FIG. 33 illustrates a bottom side perspective of the invention of FIG. 32.
Figure 34:
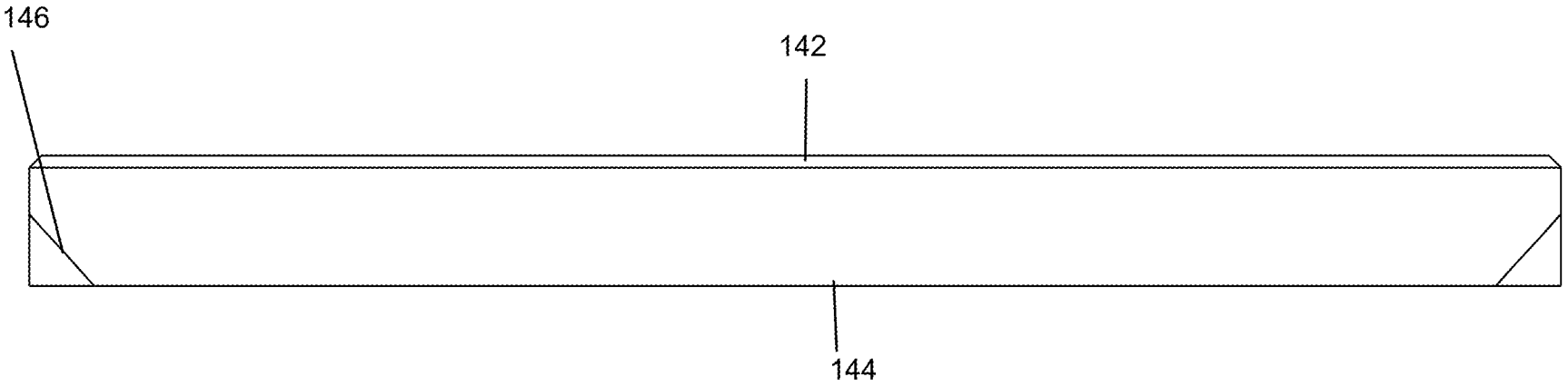
FIG. 34 illustrates a right side perspective of the invention of FIG. 33.
Figure 35:
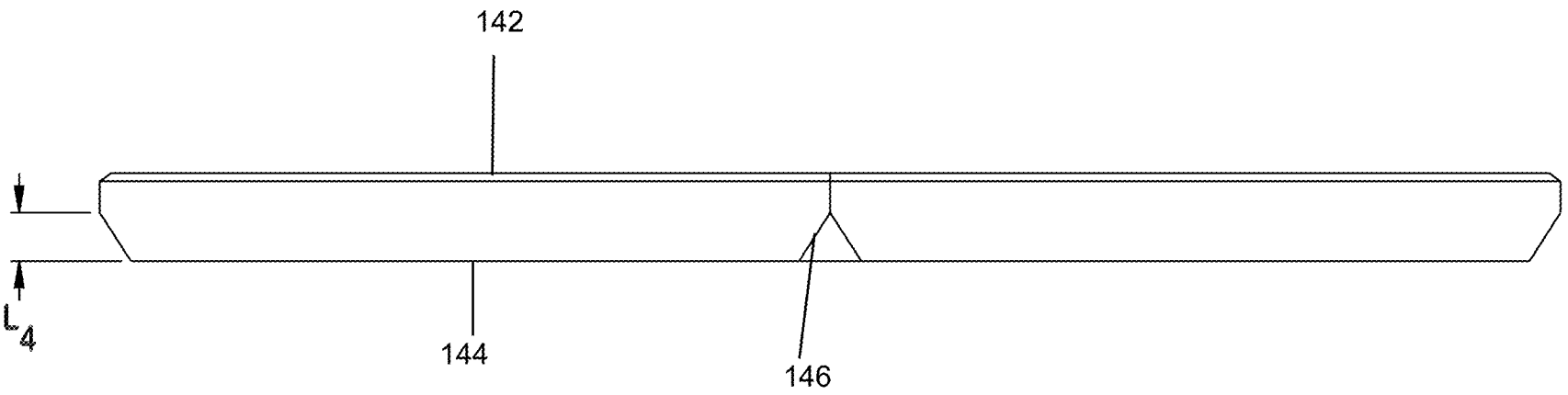
FIG. 35 illustrates a left side perspective of the invention of FIG. 34.

In the exemplary embodiment and as shown in FIGS. 30-35, a support member 140 may be a paver. The support member 140 may be a rectangular structure or another polygonal structure. One skilled in the art would understand the applicant's design is not the exclusive embodiment.

In the exemplary embodiment, the support member 140 includes a top portion 142. The support member 140 further includes a bottom portion 144 opposing the top portion 142. The support member 140 further includes a plurality of side walls 146. Each of the four side walls 146 may taper from the top portion 142 to the bottom portion 144.

In the exemplary embodiment, the support member 140 further includes a plurality of corner sections 148. The plurality of corner sections 148 may have a taper extending from the bottom portion 144 to the central portion of the side wall 146. The support member 140 further includes a plurality of paver insert receivers 150.

In the exemplary embodiment, the four paver insert receivers 150 each allow for an insert assembly 2 to couple within the corresponding paver insert receivers 150. Each paver insert receiver 150 mirrors the structure of the insert assembly 2 permitting a friction fit.

Figure 36:
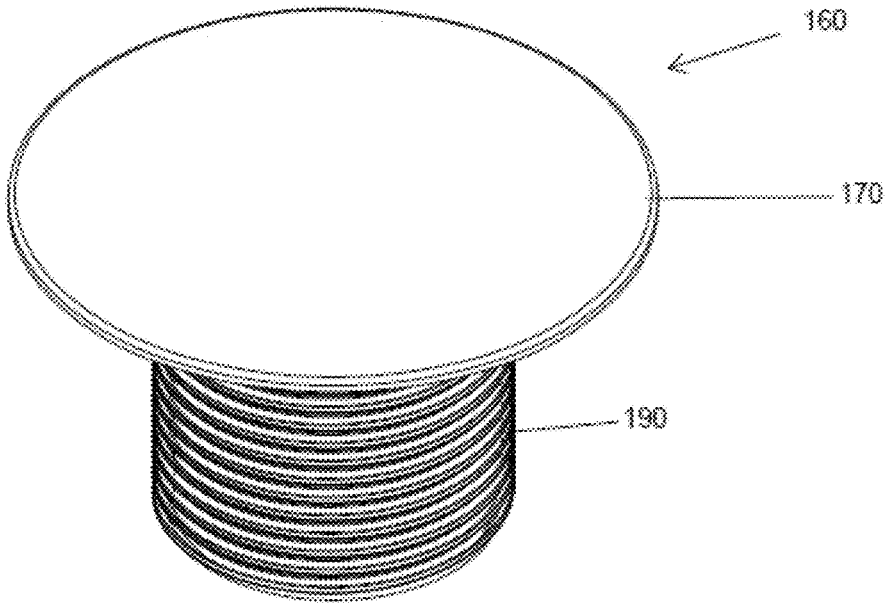
FIG. 36 illustrates a top, front, right side perspective view.
Figure 37:
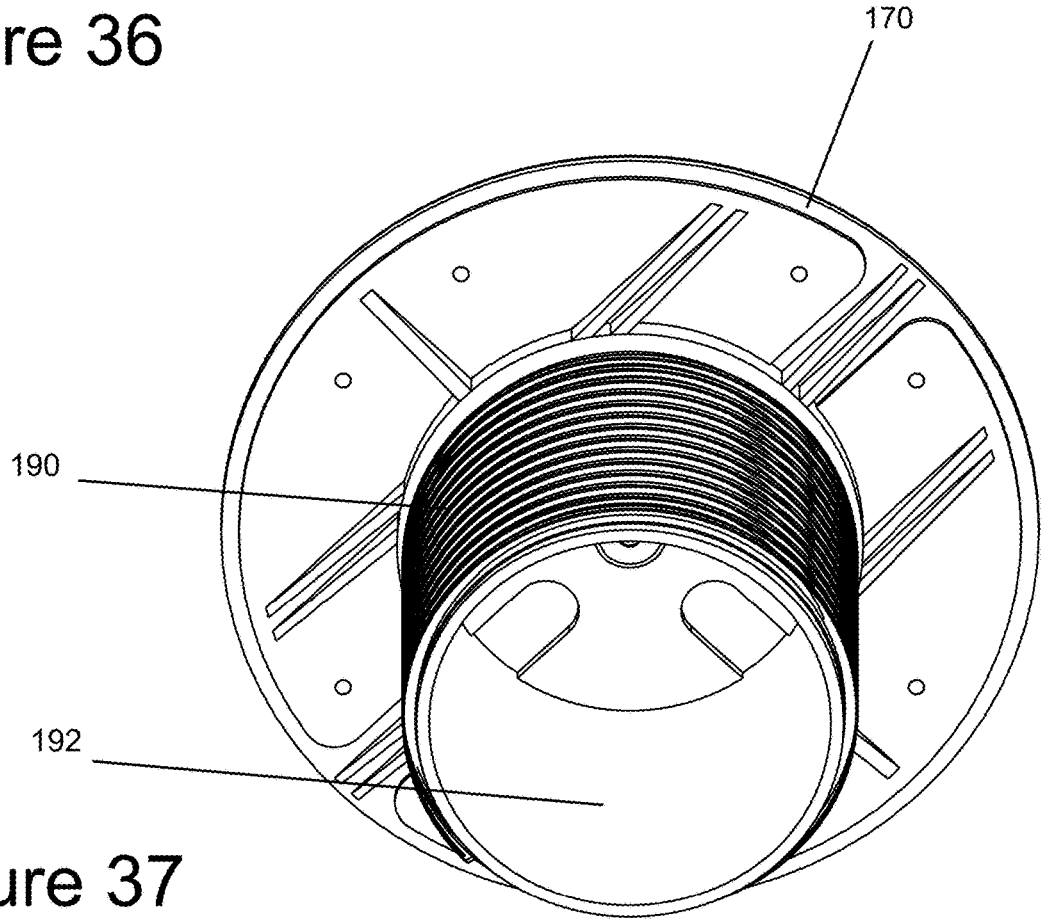
FIG. 37 illustrates a bottom, rear, left side perspective view of FIG. 36.
Figure 38:
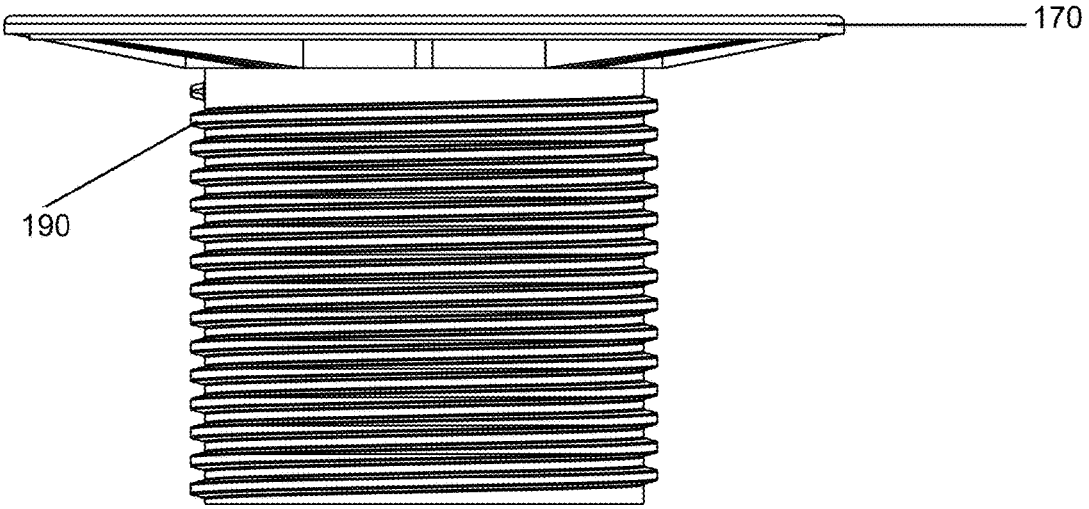
FIG. 38 illustrates a right side perspective view of FIG. 37.
Figure 39:
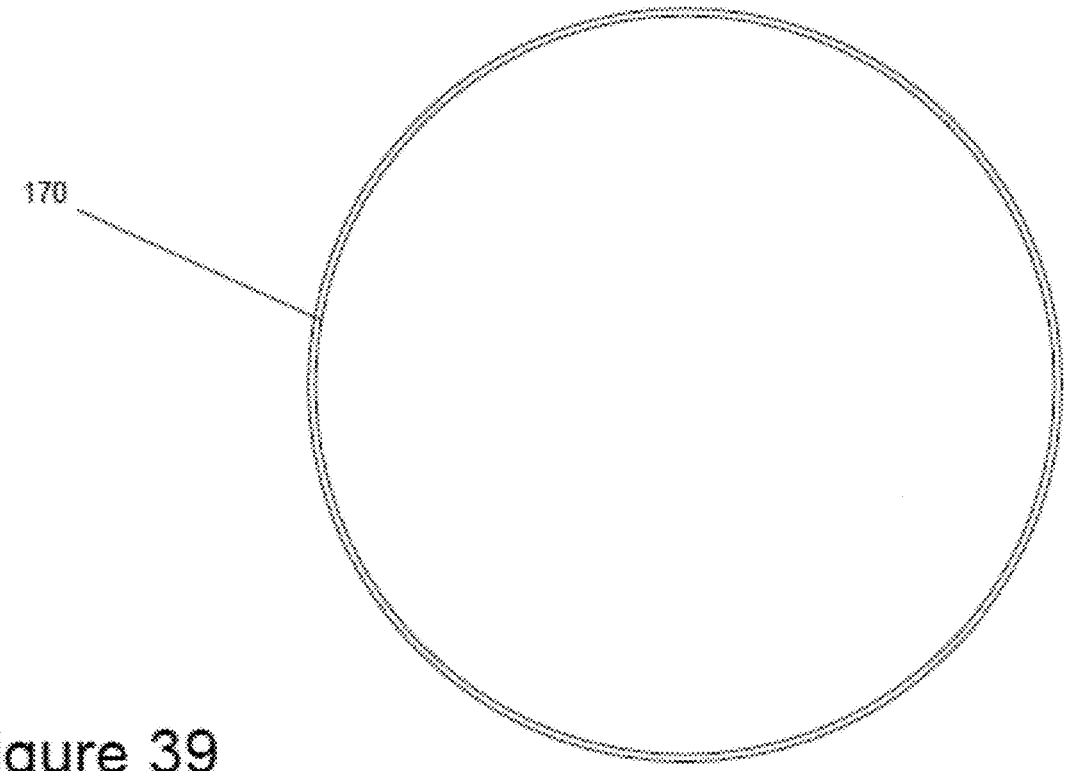
FIG. 39 illustrates a top side perspective view of FIG. 38.
Figure 40:
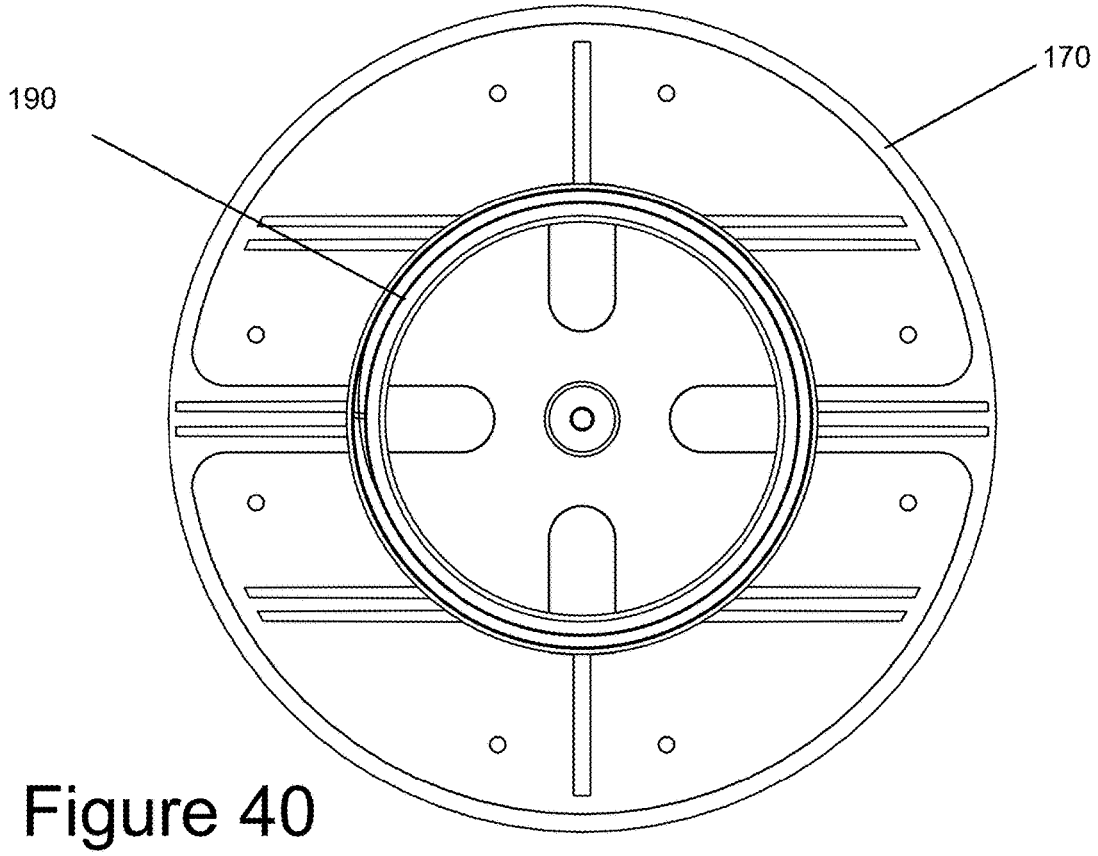
FIG. 40 illustrates a bottom perspective view of FIG. 39.
Figure 41:
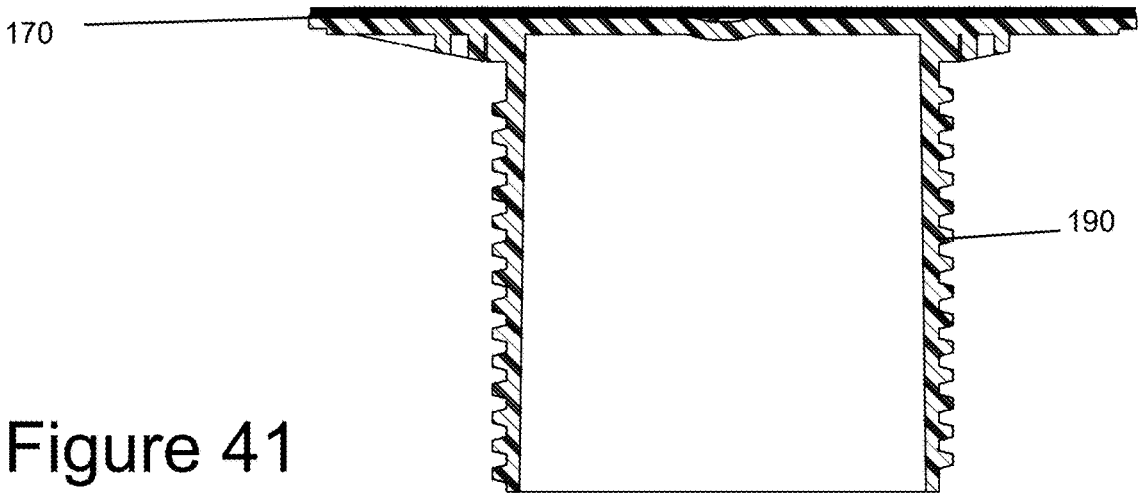
FIG. 41 illustrates a cross-sectional perspective view of FIG. 40.

In the exemplary embodiment and as shown in FIGS. 36-41, the pedestal 160, generally includes a top plate 170, a plate extender 190, and a pedestal column 200.

In the exemplary embodiment, the top plate 170 is substantially round with a circumference.

In the exemplary embodiment, and as shown in FIGS. 36-41, positioned and extending from beneath the bottom of the top plate 170, along a central columnar section, is a plate extender 190. The plate extender 190 has a threaded surface extending substantially around the plate extender 190 and along the length of the plate extender 190. The plate extender 190 further includes an inner hollow surface 192.

Figure 42:
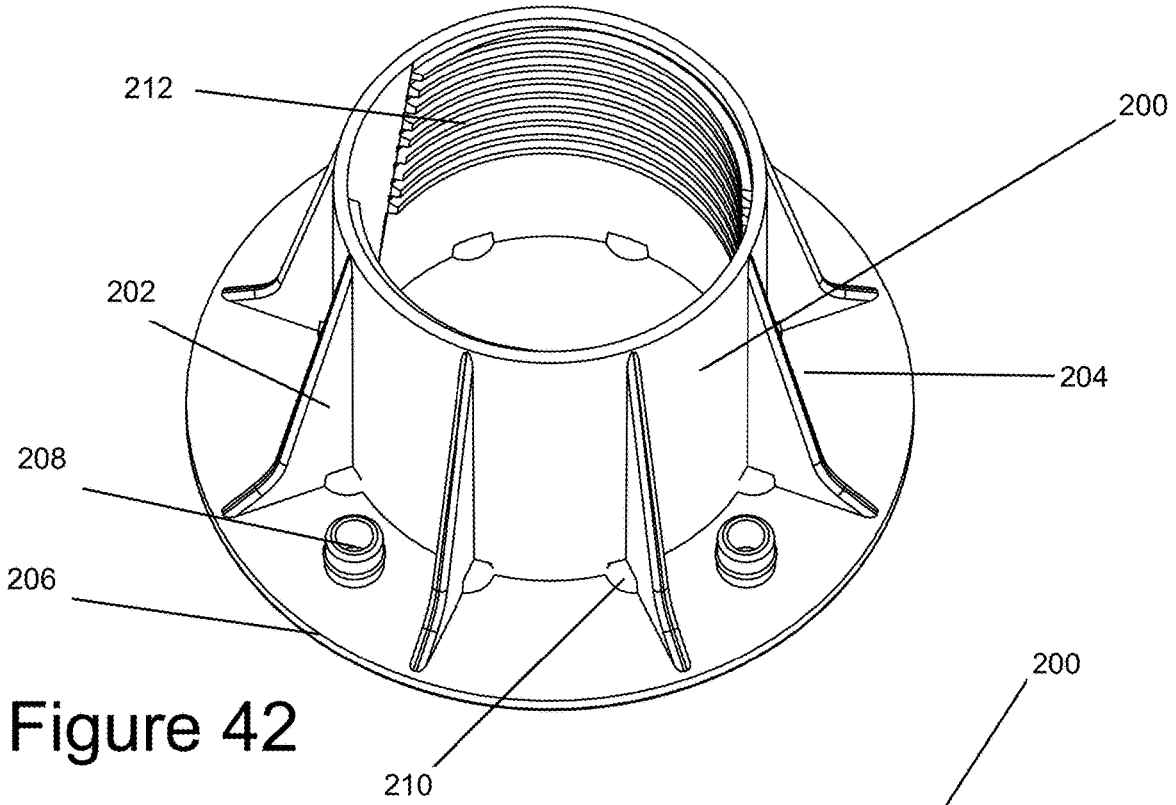
FIG. 42 illustrates a top, front, right side perspective view.
Figure 43:
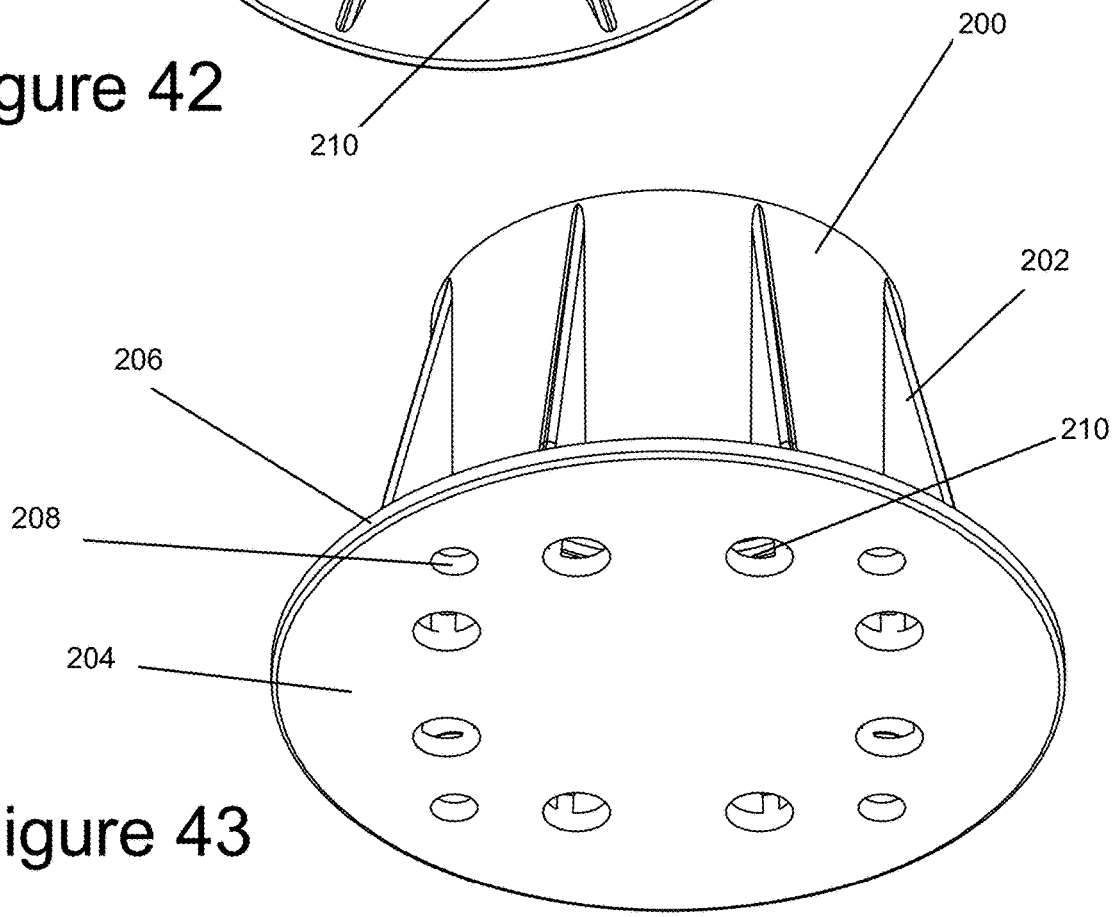
FIG. 43 illustrates a bottom, rear, left side perspective view of FIG. 42.
Figure 44:
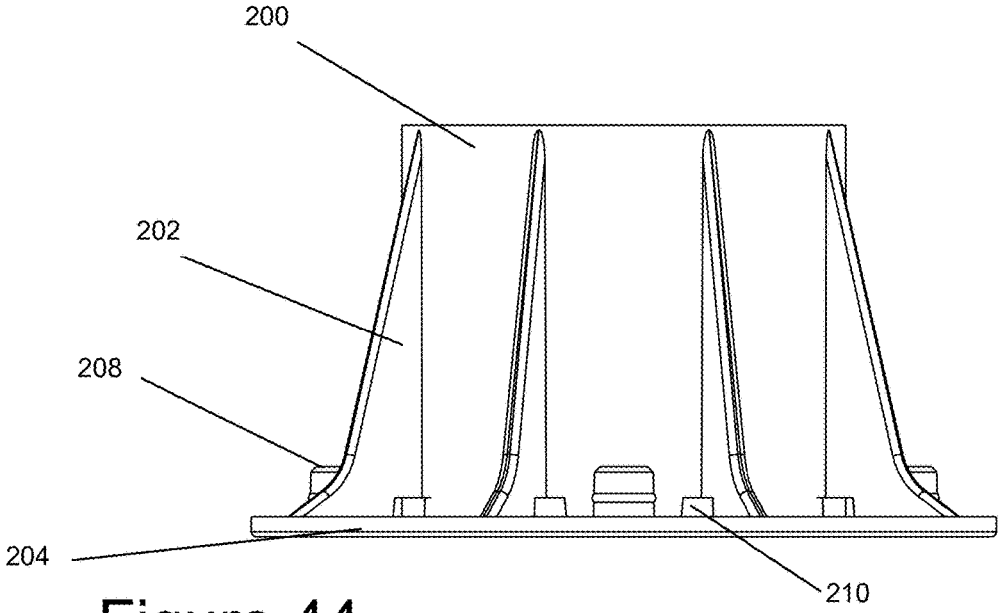
FIG. 44 illustrates a right side perspective view of FIG. 43.
Figure 45:
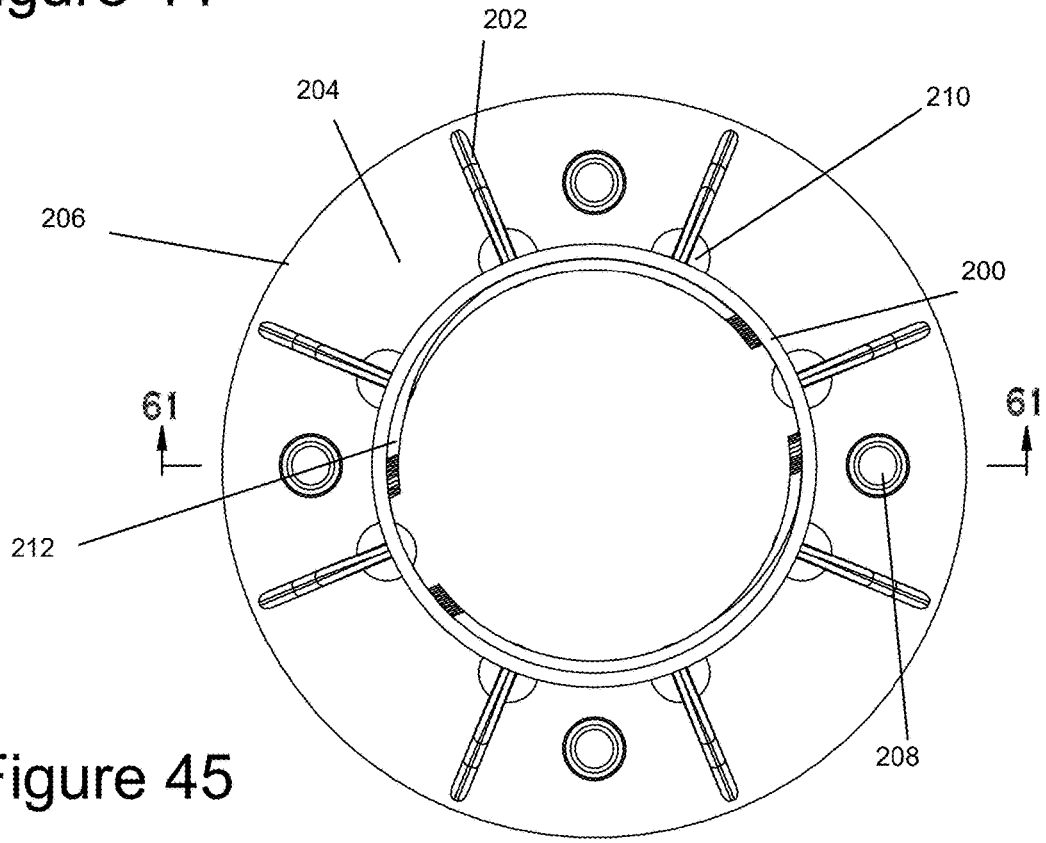
FIG. 45 illustrates a top perspective view of FIG. 44.
Figure 46:
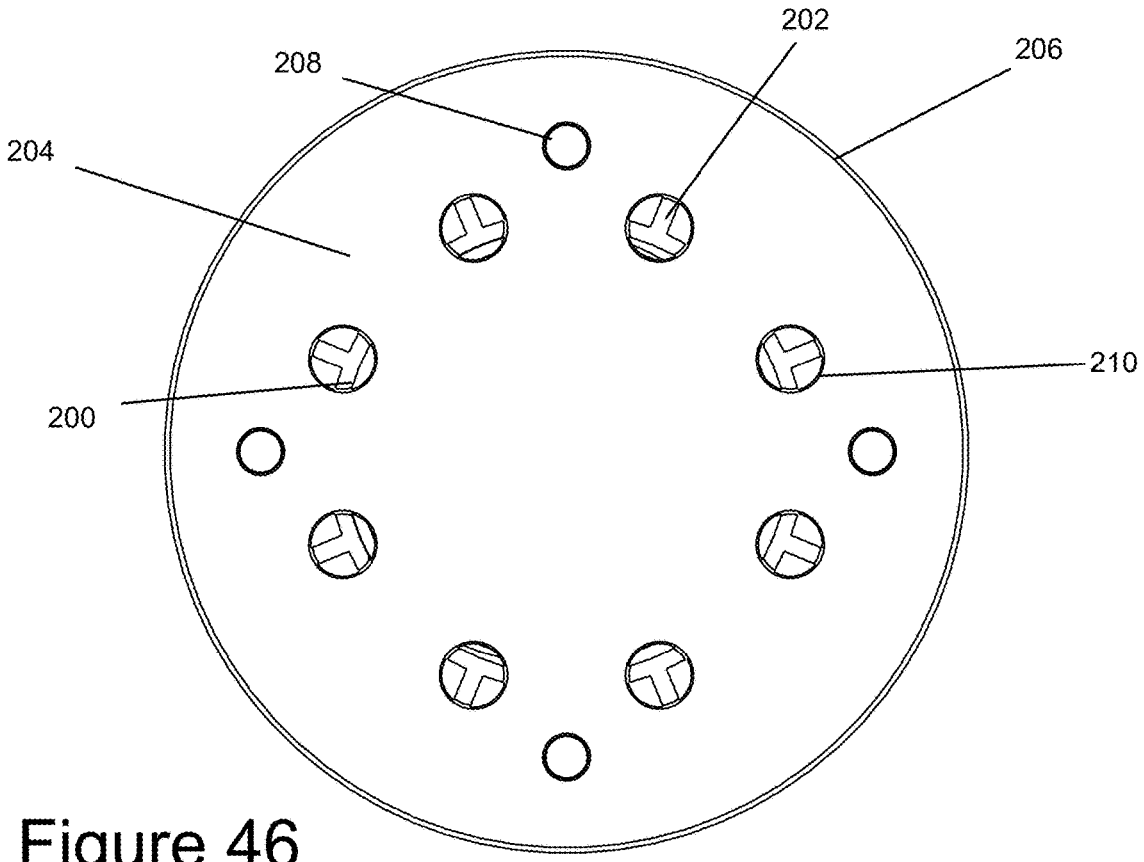
FIG. 46 illustrates a bottom perspective view of FIG. 45.
Figure 47:
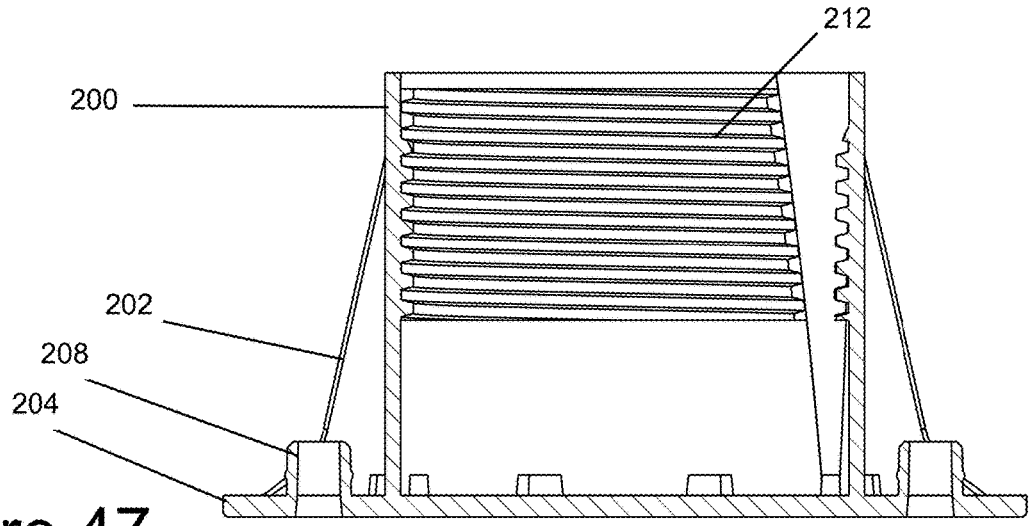
FIG. 47 illustrates a cross-sectional view of FIG. 46.

As shown in FIGS. 42-47, the pedestal column 200 is positioned along a vertical section of the pedestal 160. Extending around a circumference of the pedestal column 200 are a plurality of reinforcement arms 202. At an end of the pedestal column 200 is a circular base 204. The circular base 204 forms a flange 206 with a plurality of fastener openings 208 positioned along a face of the circular base 204. The plurality of fastener openings 208 are positioned along the face in an alternating pattern between the plurality of reinforcement arms 202.

In the exemplary embodiment, the circular base 204 further includes a plurality of passageways 210. The plurality of passageways 210 form between the pedestal column 200 and the reinforcement arms 202. One skilled in the art would understand the applicant's design is not the exclusive embodiment.

In the exemplary embodiment, along an inner surface of the pedestal column 200 is an interior thread 212. The interior thread 212 extends substantially along the length and the inner circumference of the pedestal column 200. The interior thread 212 provides substantial displacement along the interior of the pedestal column 200 in a positive and negative column height direction.

In another exemplary embodiment, the interior thread 212 extends entirely around the inner surface of the pedestal column 200.

Figure 48:
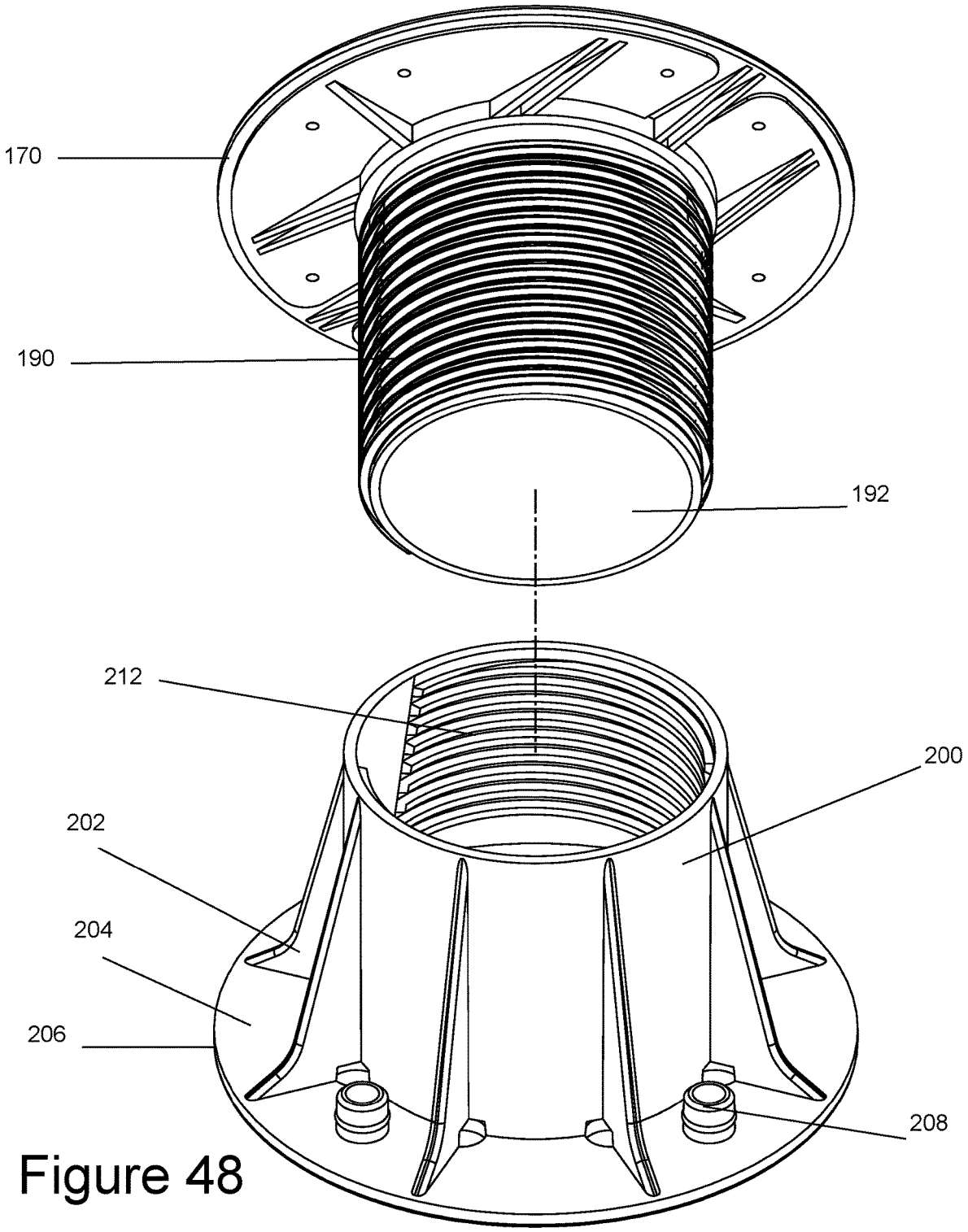
FIG. 48 illustrates a perspective view.
Figure 49:
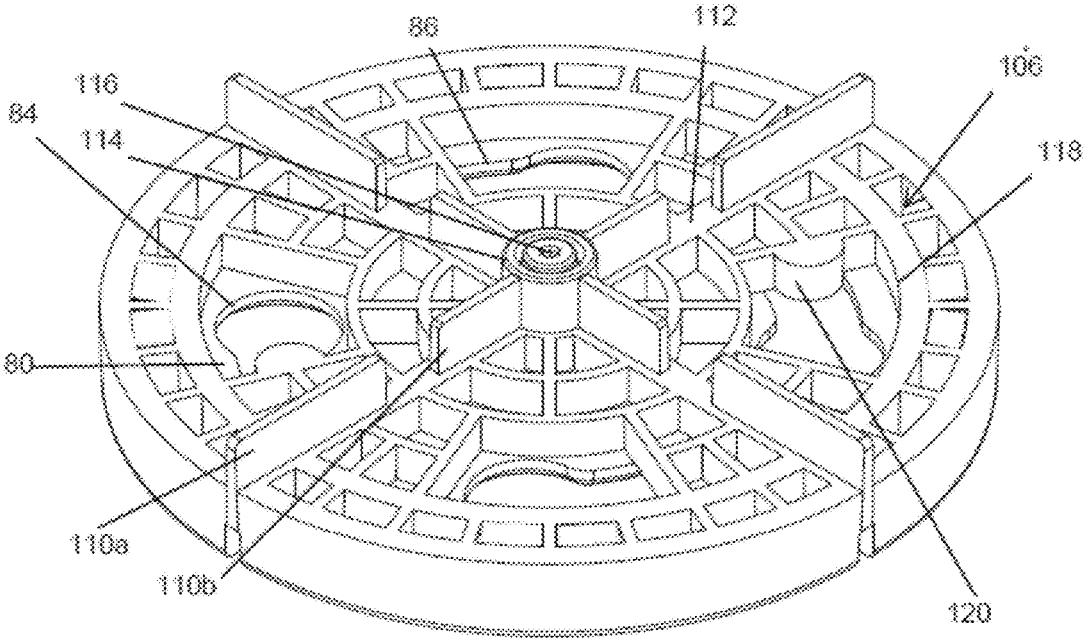
FIG. 49 illustrates a top, front, right side perspective view.
Figure 50:
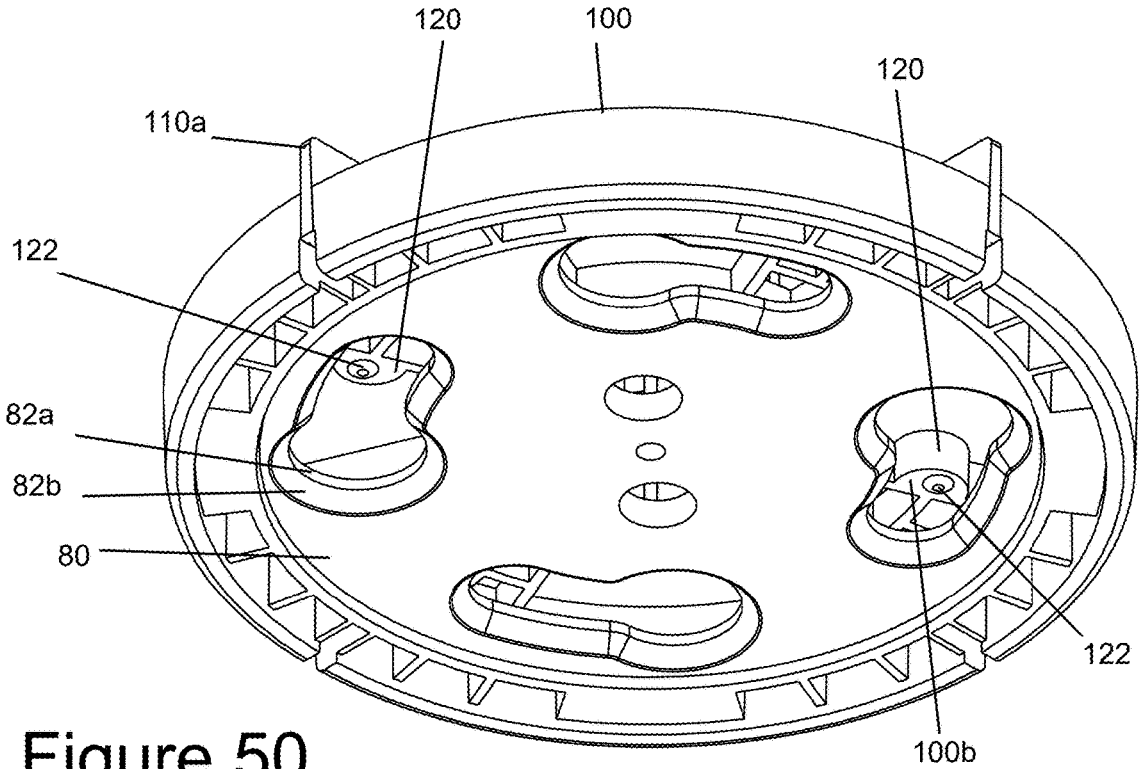
FIG. 50 illustrates a bottom, rear, left side perspective view of FIG. 49.
Figure 51:
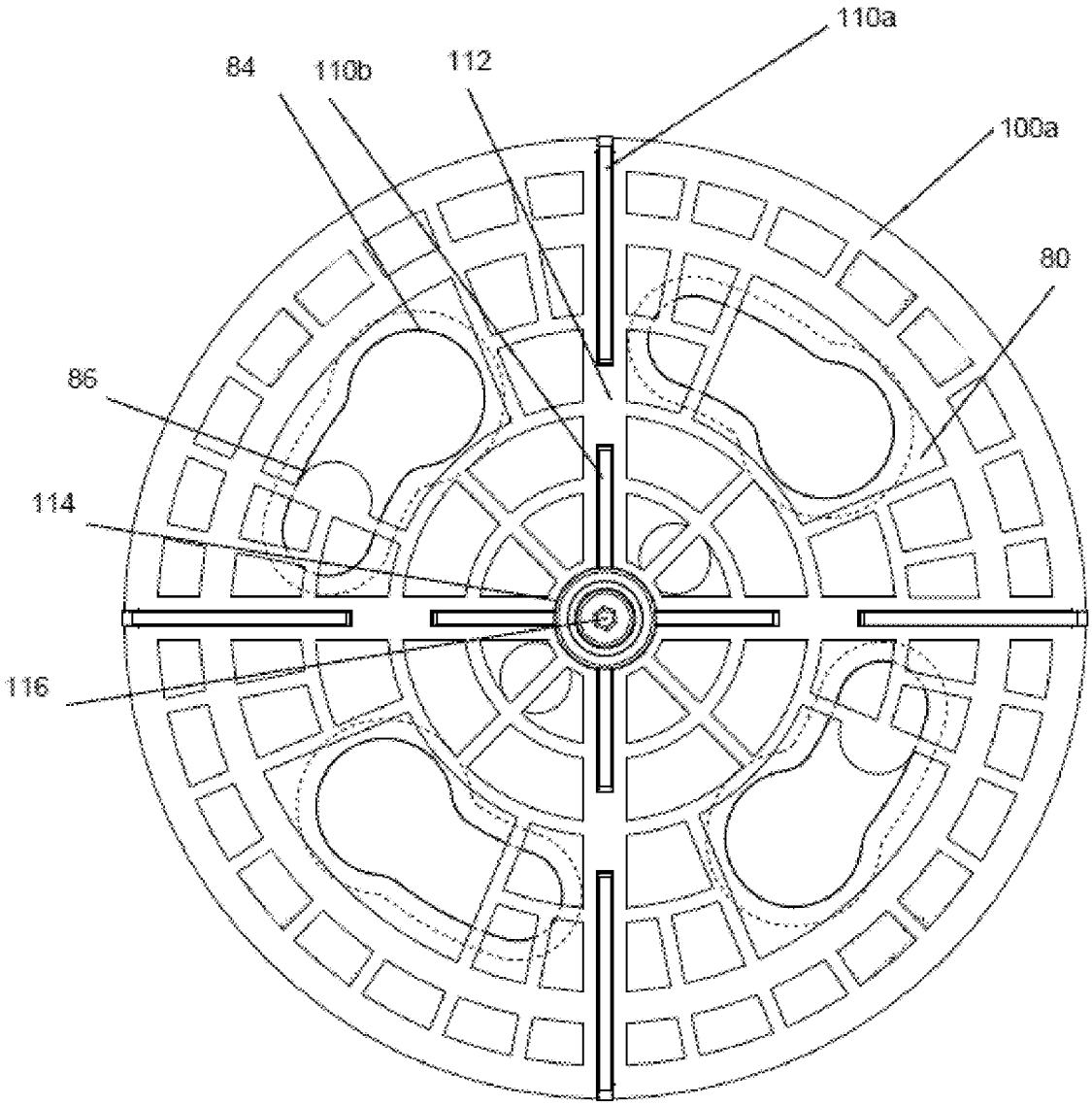
FIG. 51 illustrates a top perspective view of FIG. 50.
Figure 52:
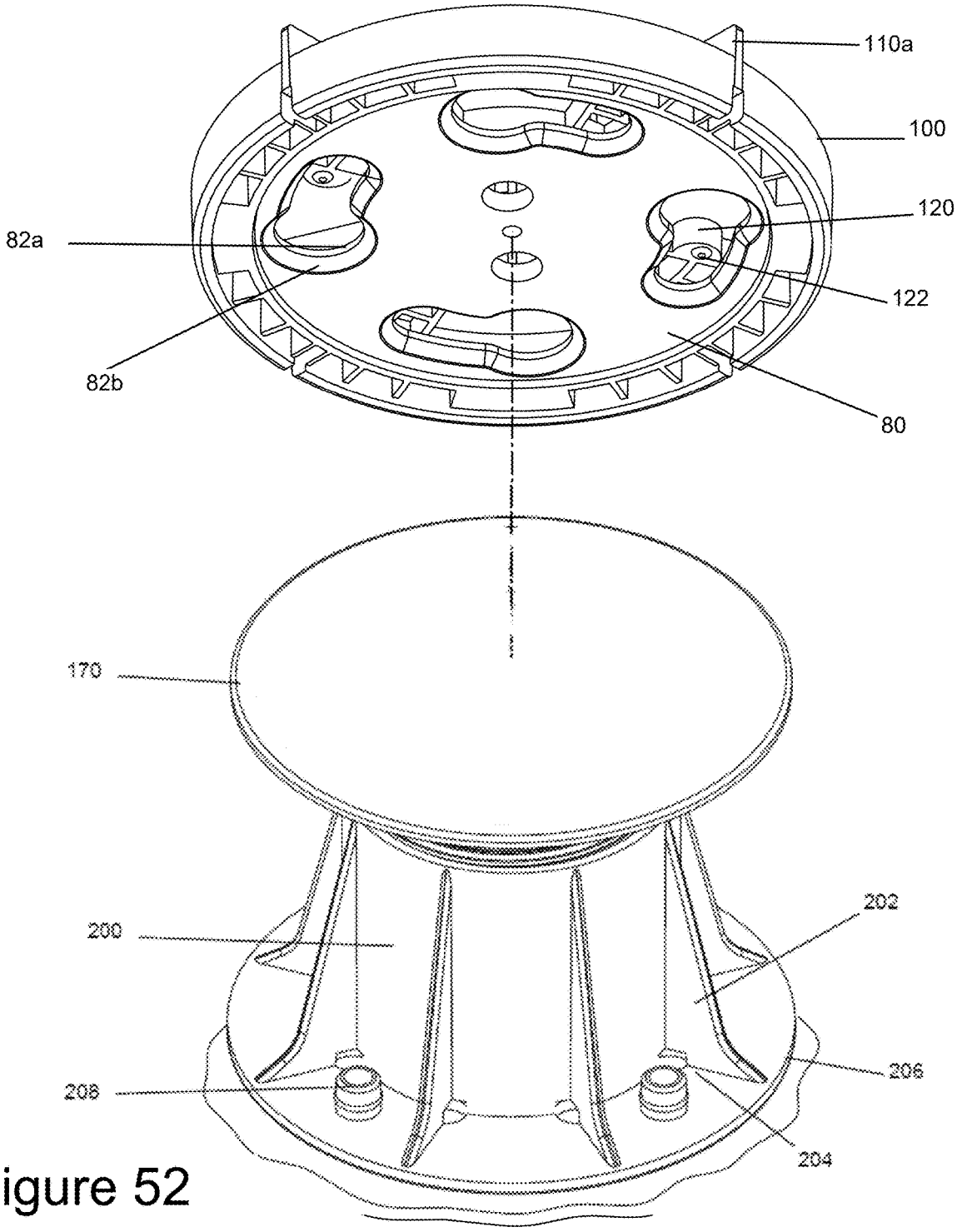
FIG. 52 illustrates a perspective view.
Figure 53:
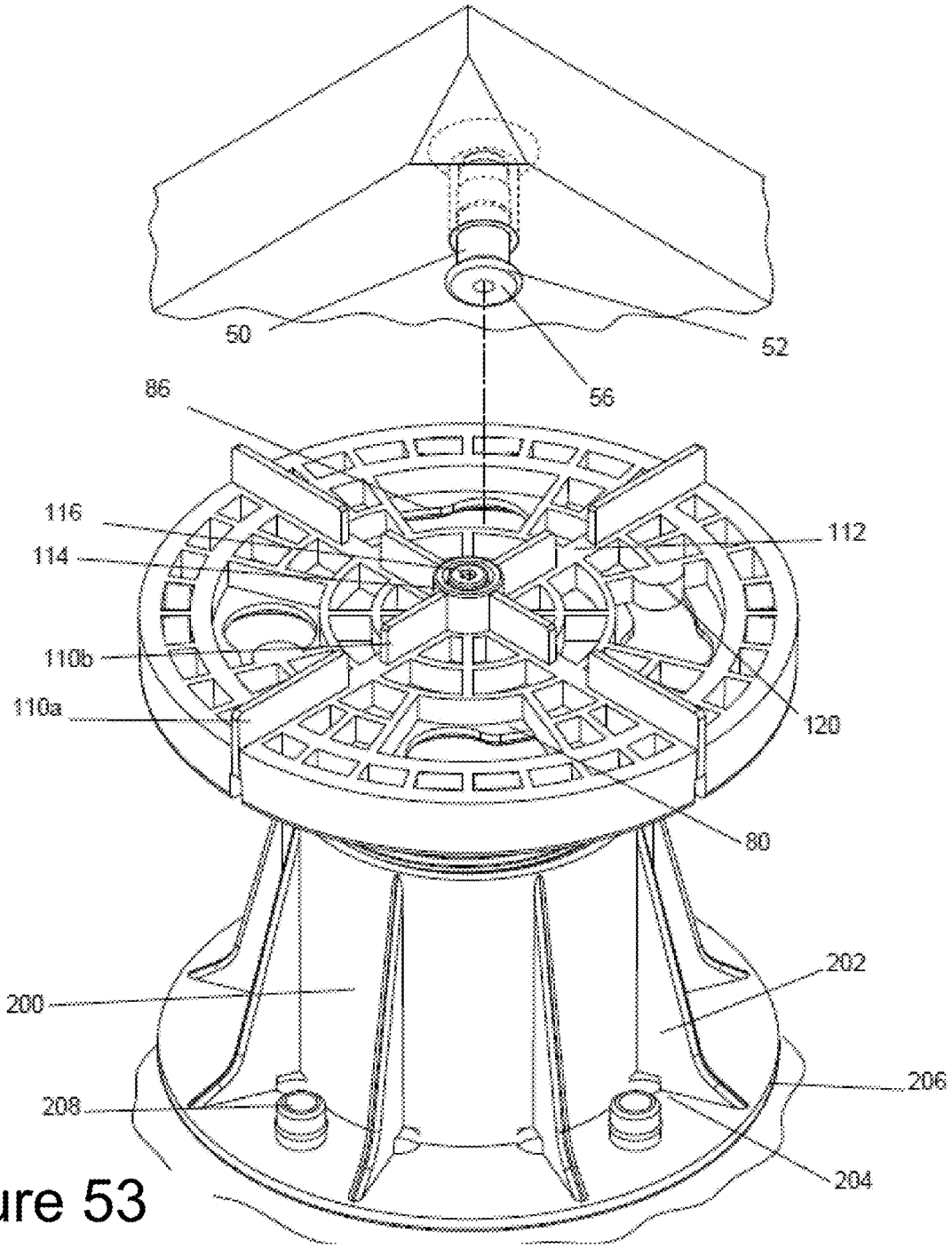
FIG. 53 illustrates another perspective view.
Figure 54:
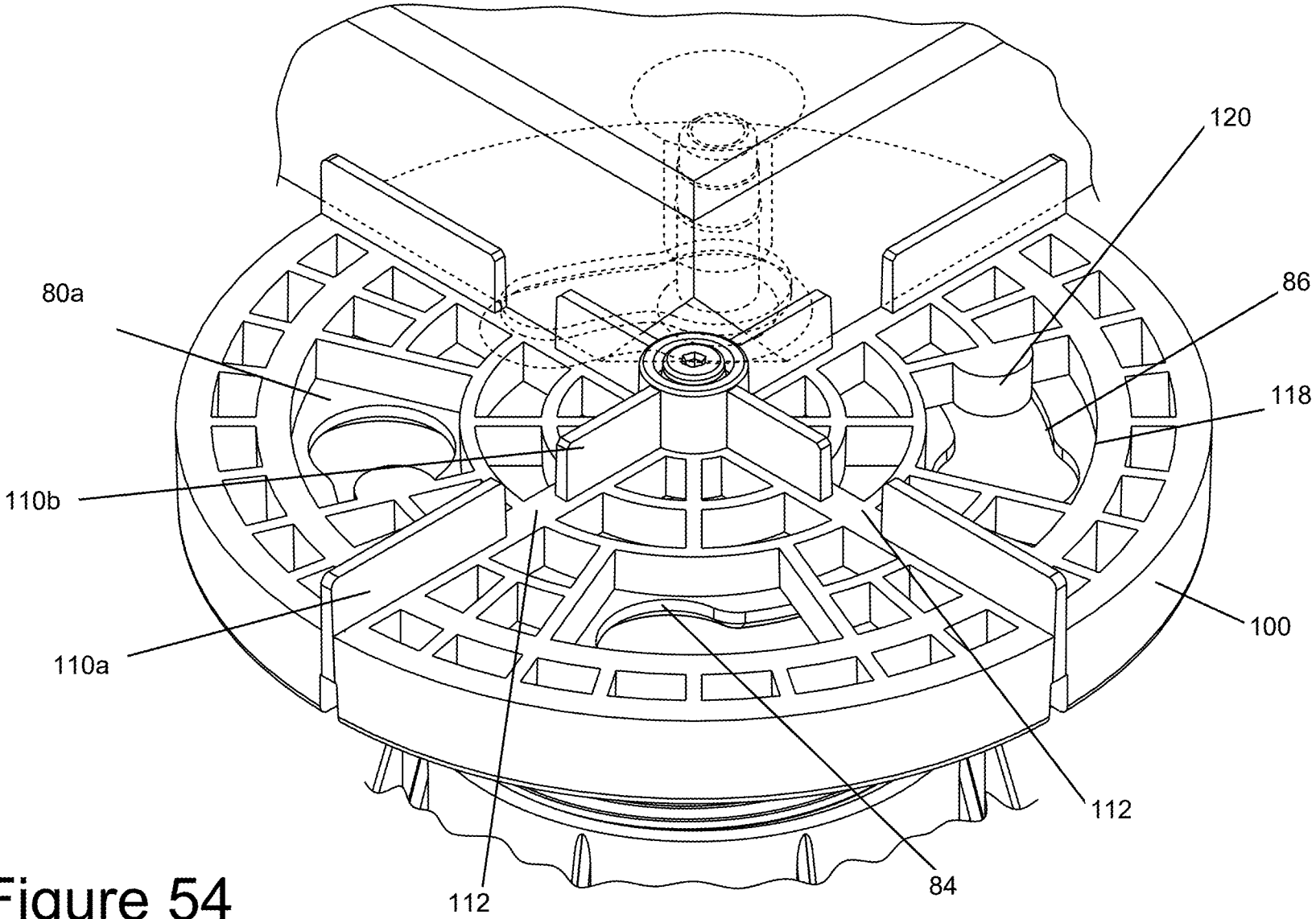
FIG. 54 illustrates another perspective view.
Figure 55:
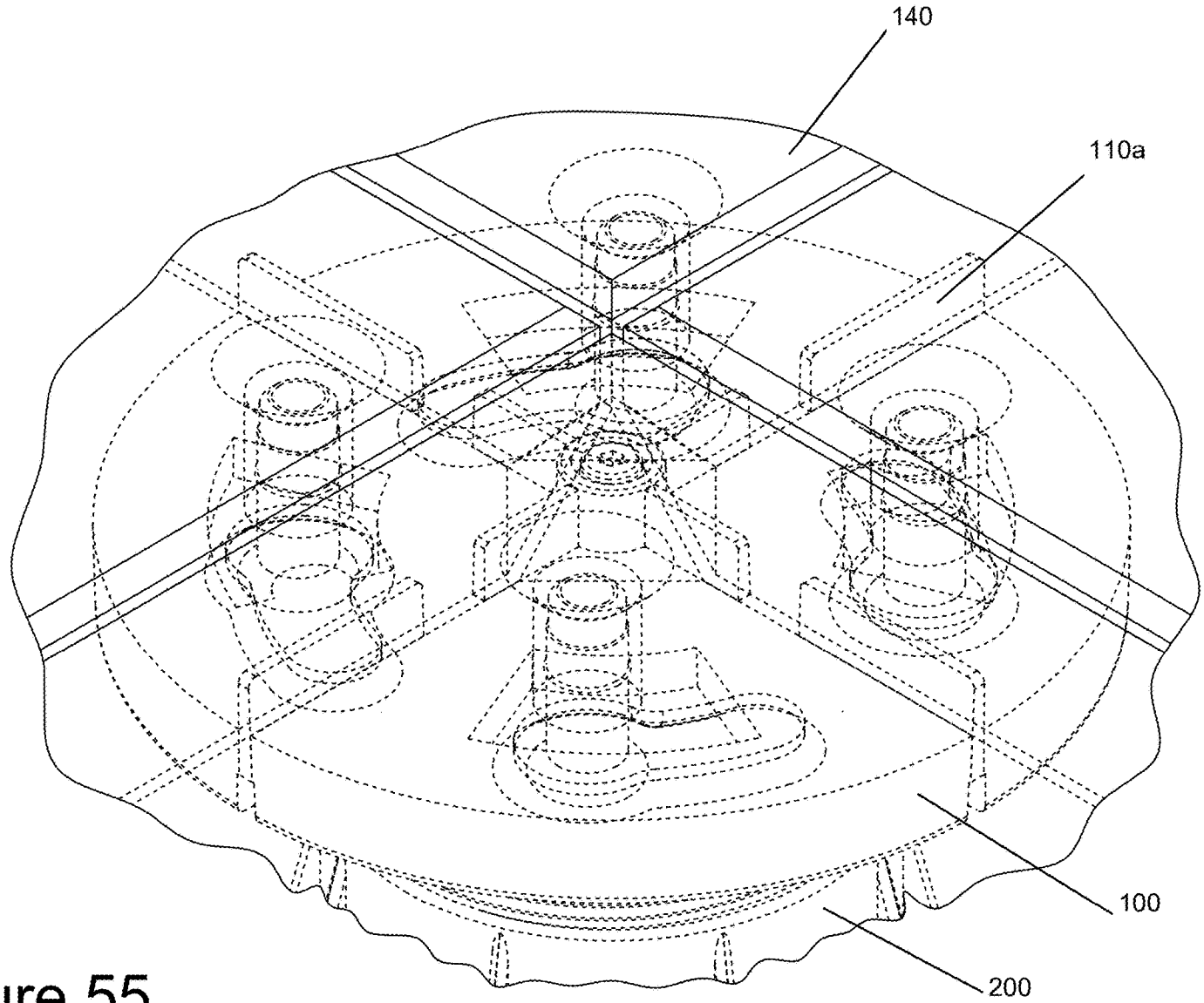
FIG. 55 illustrates another perspective view.
Figure 56:
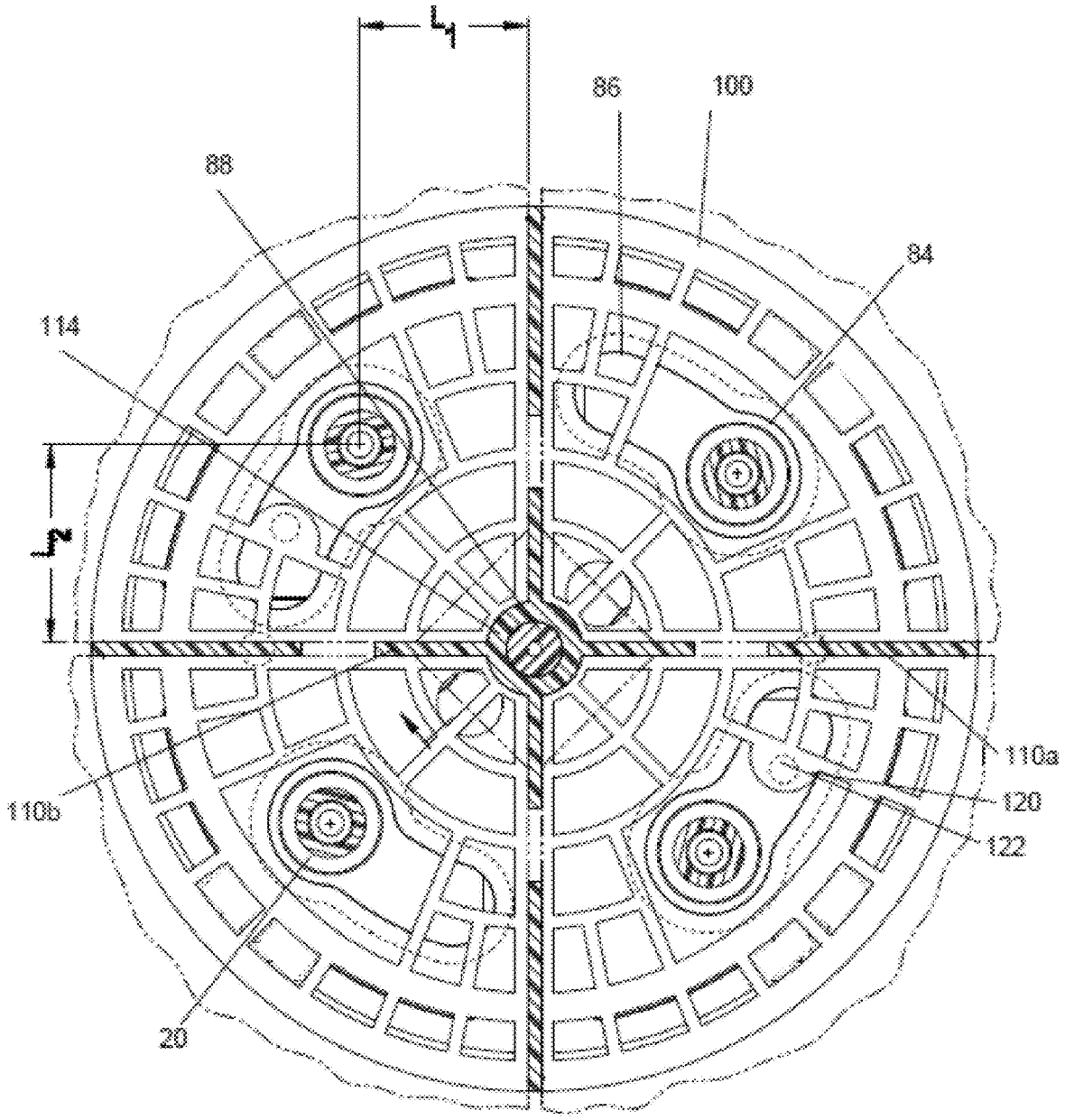
FIG. 56 illustrates a top perspective view.
Figure 57:
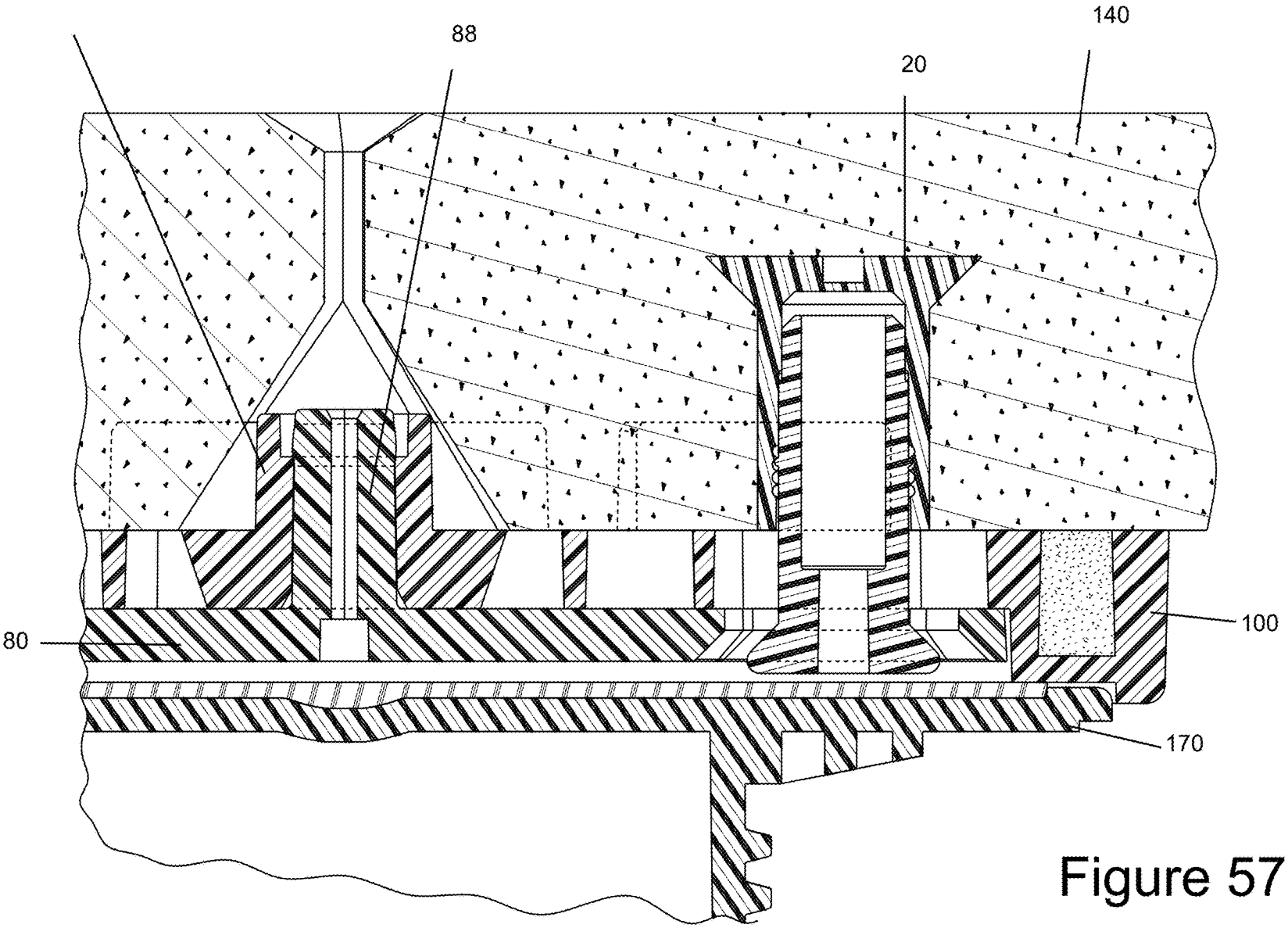
FIG. 57 illustrates a cross-sectional view.
Figure 58:
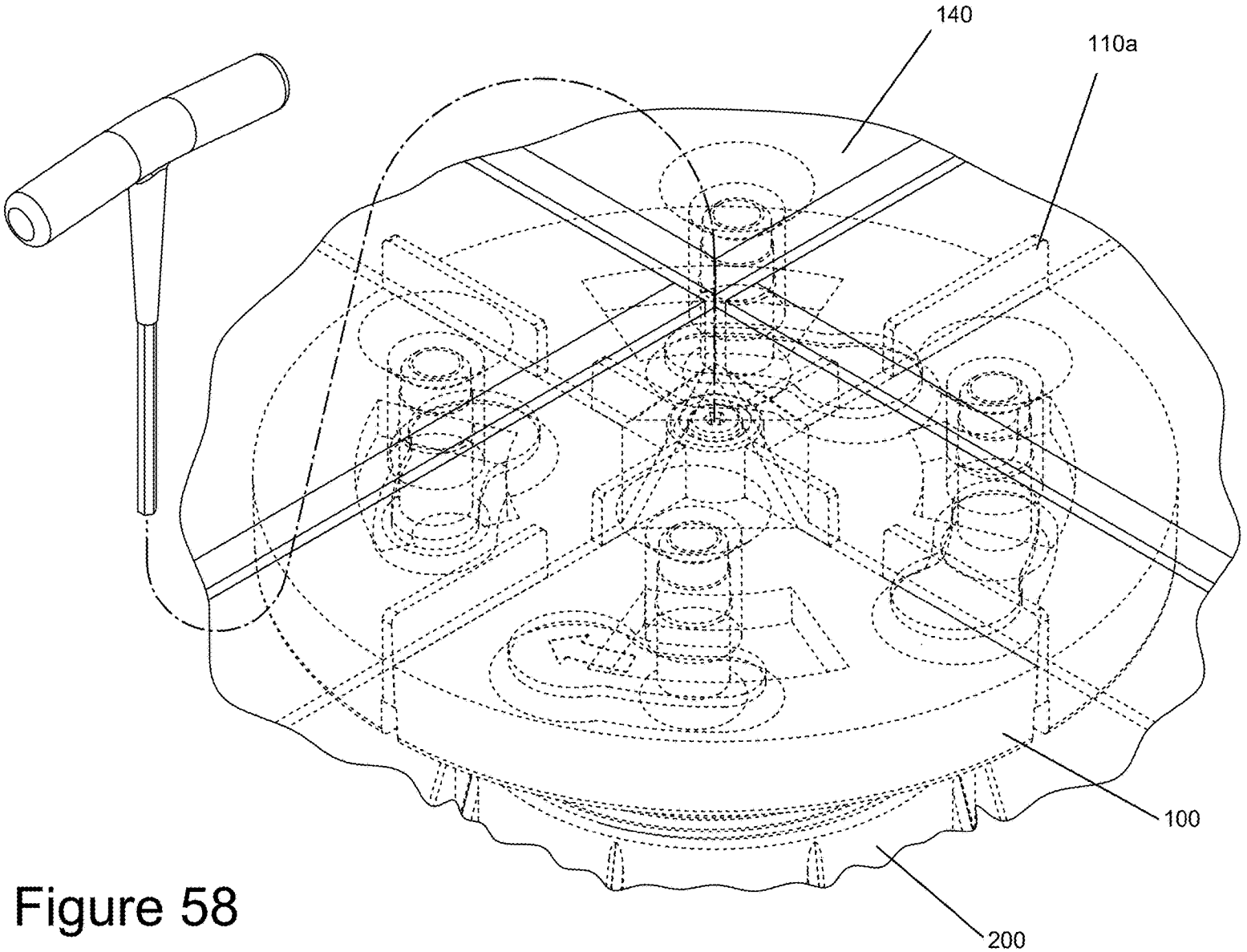
FIG. 58 illustrates another perspective view.
Figure 59:
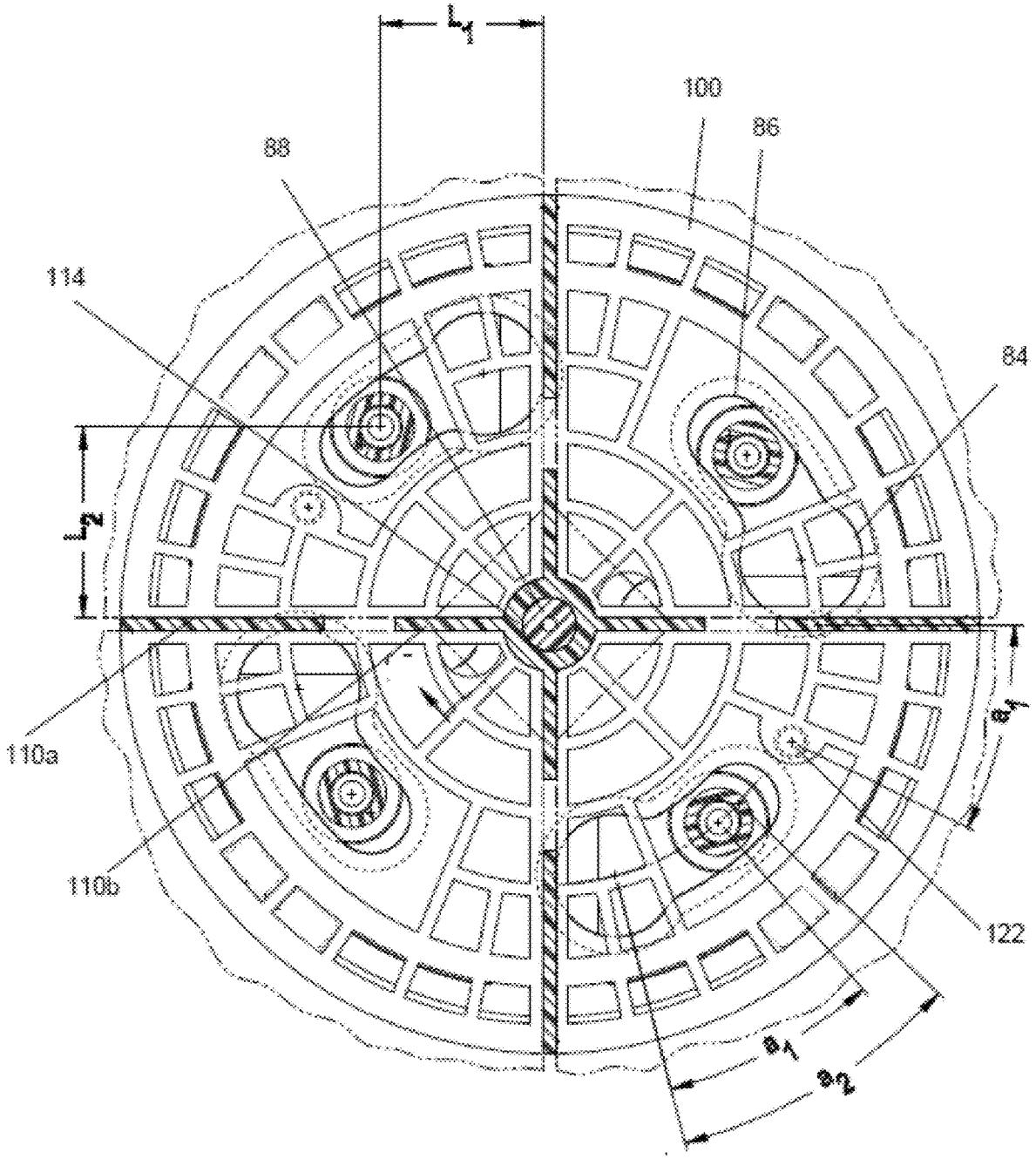
FIG. 59 illustrates a top perspective view.
Figure 60:
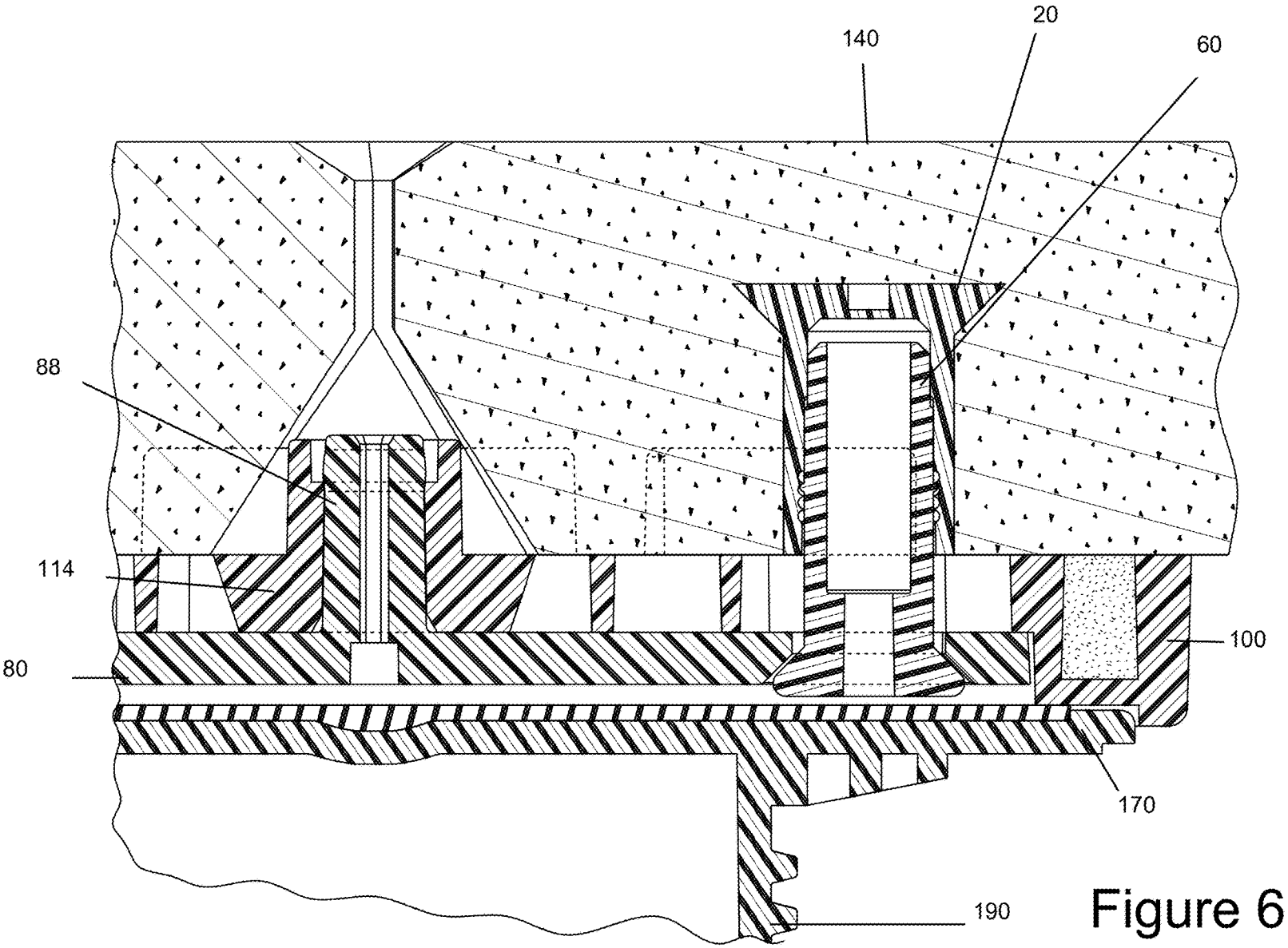
FIG. 60 illustrates another cross-sectional view.
Figure 61:
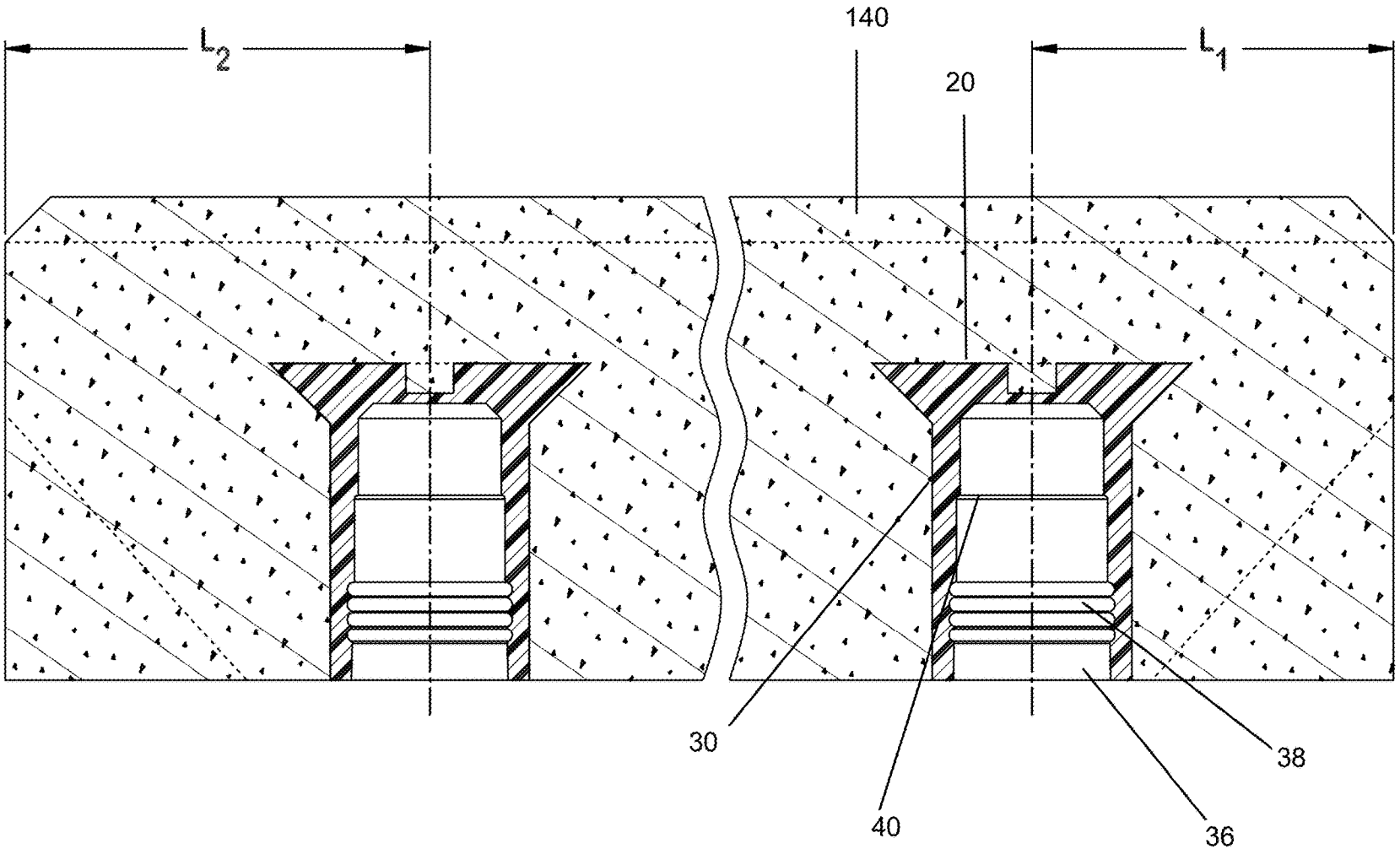
FIG. 61 illustrates another cross-sectional view.
Figure 62:
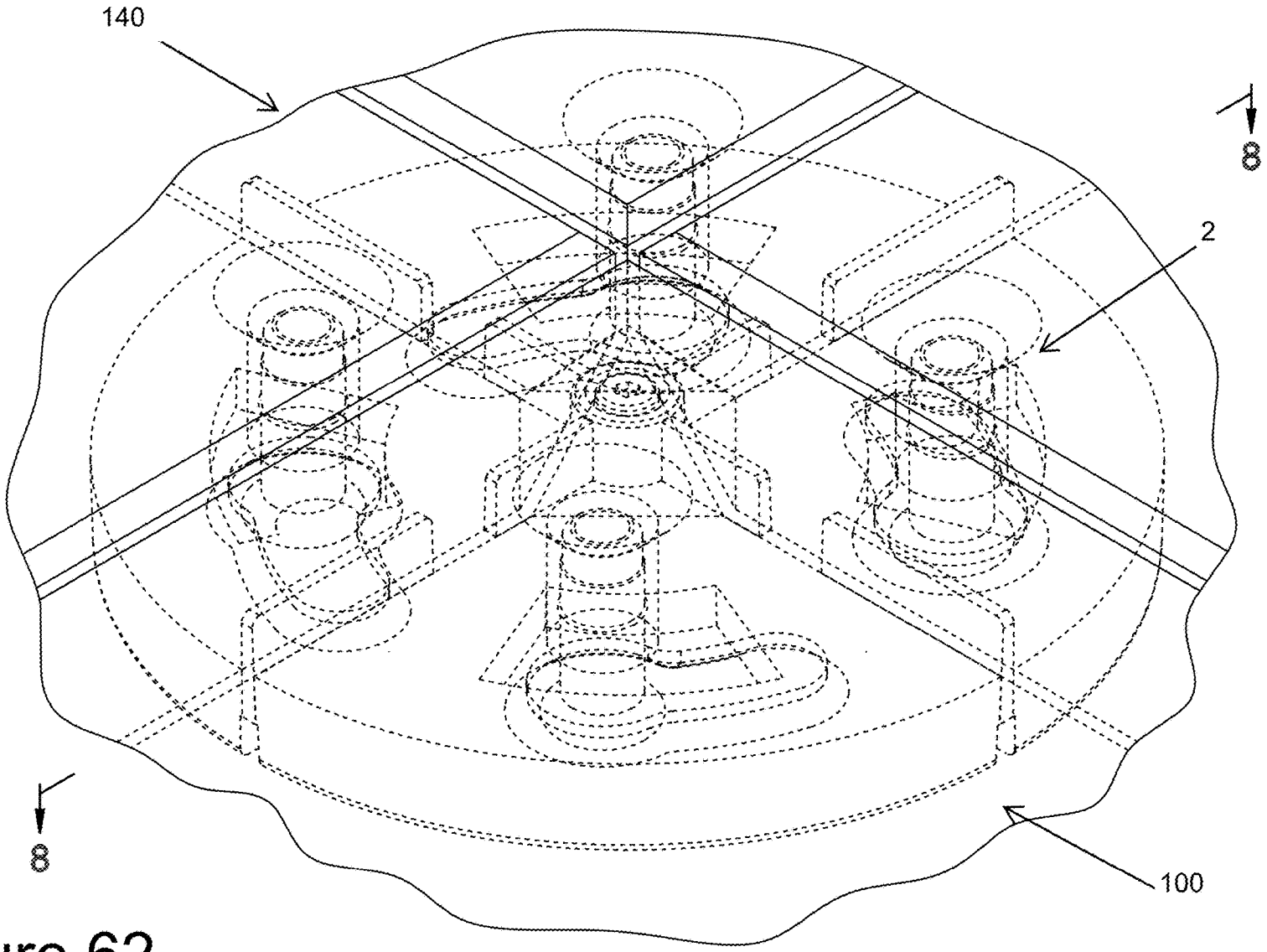
FIG. 62 illustrates another perspective view.
Figure 63:
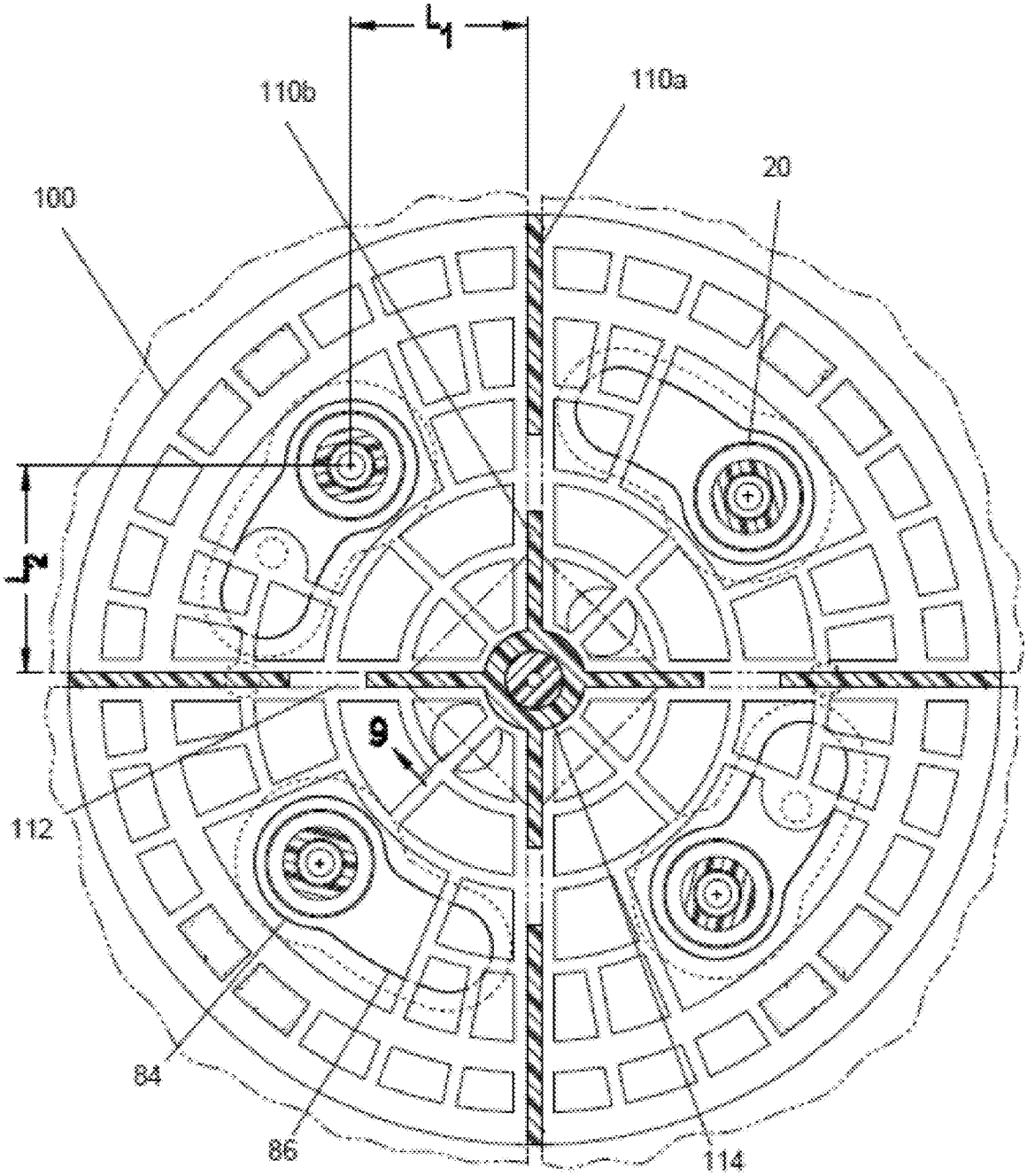
FIG. 63 illustrates a top perspective view.
Figure 64:
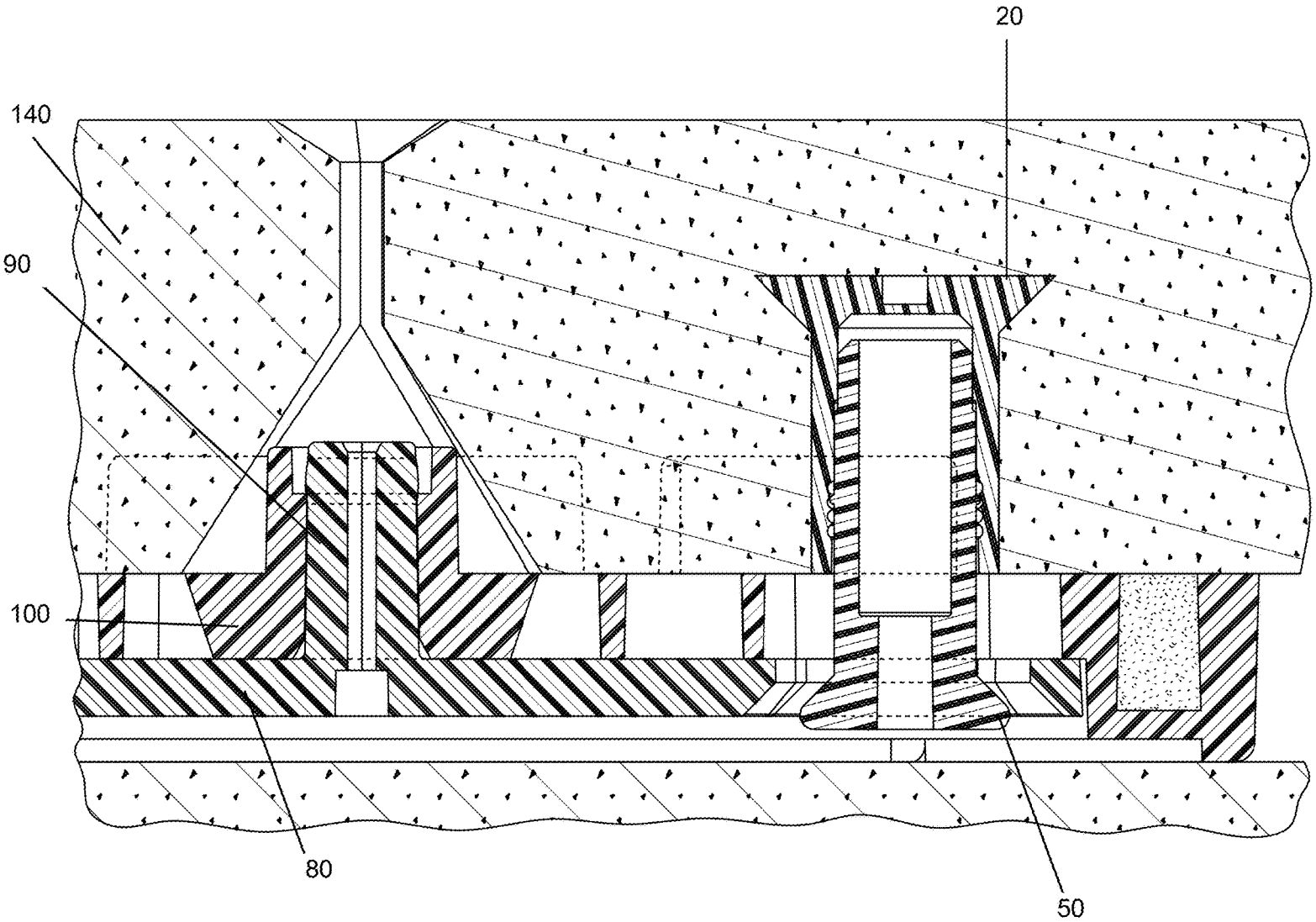
FIG. 64 illustrates a cross-sectional view.
Figure 65:
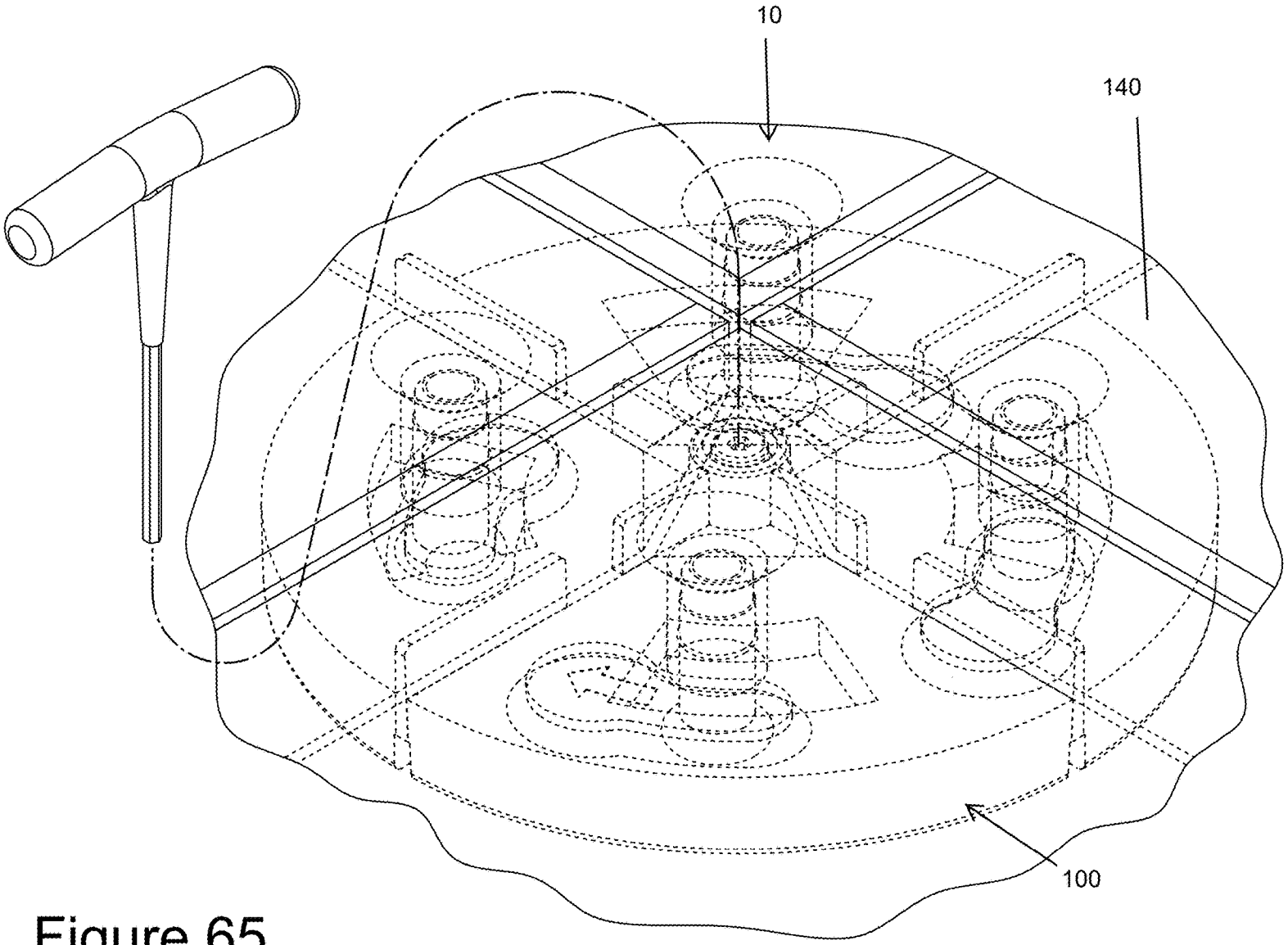
FIG. 65 illustrates another perspective view.
Figure 66:
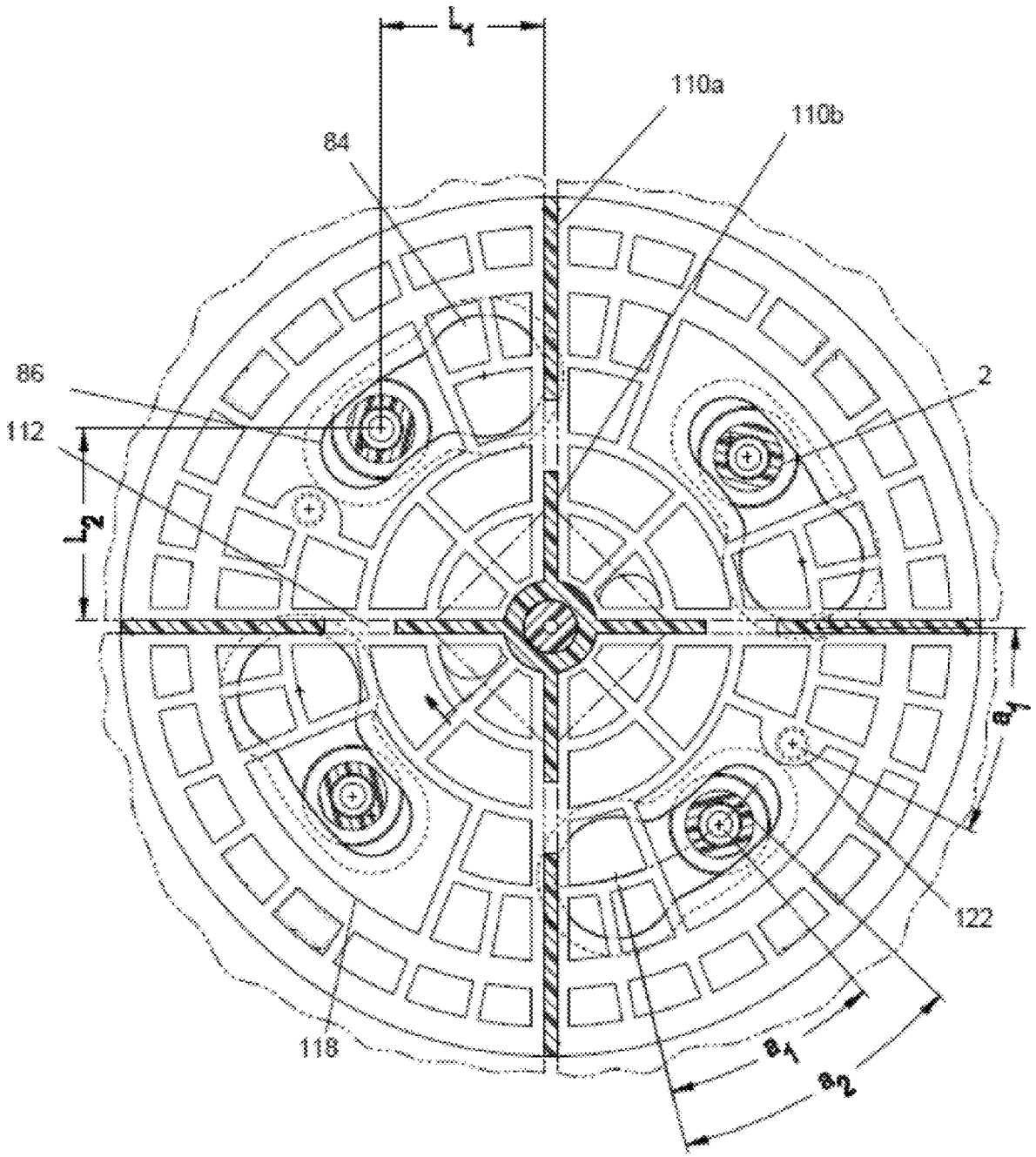
FIG. 66 illustrates a top perspective view.
Figure 67:
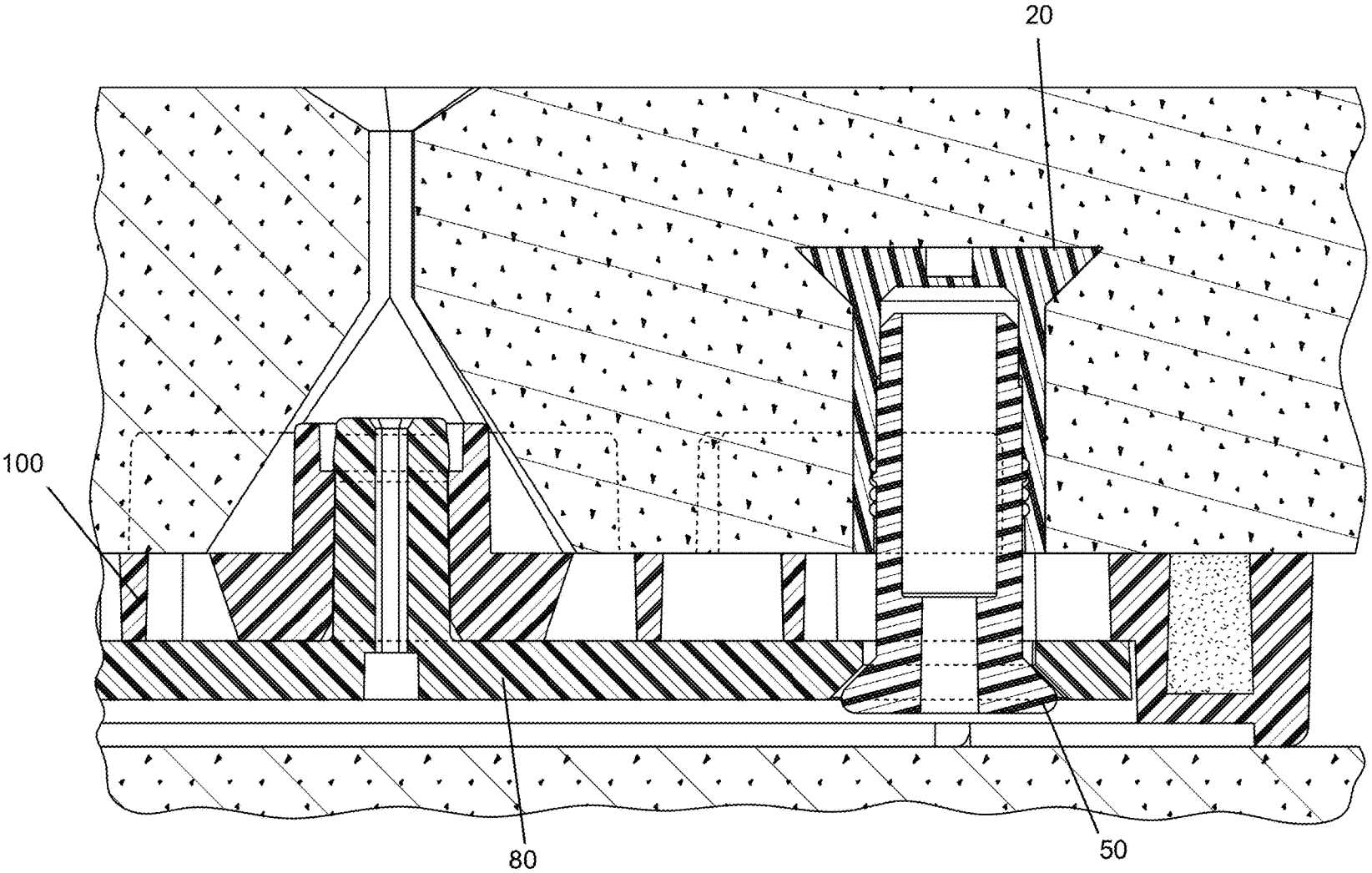
FIG. 67 illustrates a cross-sectional view.
Figure 68:
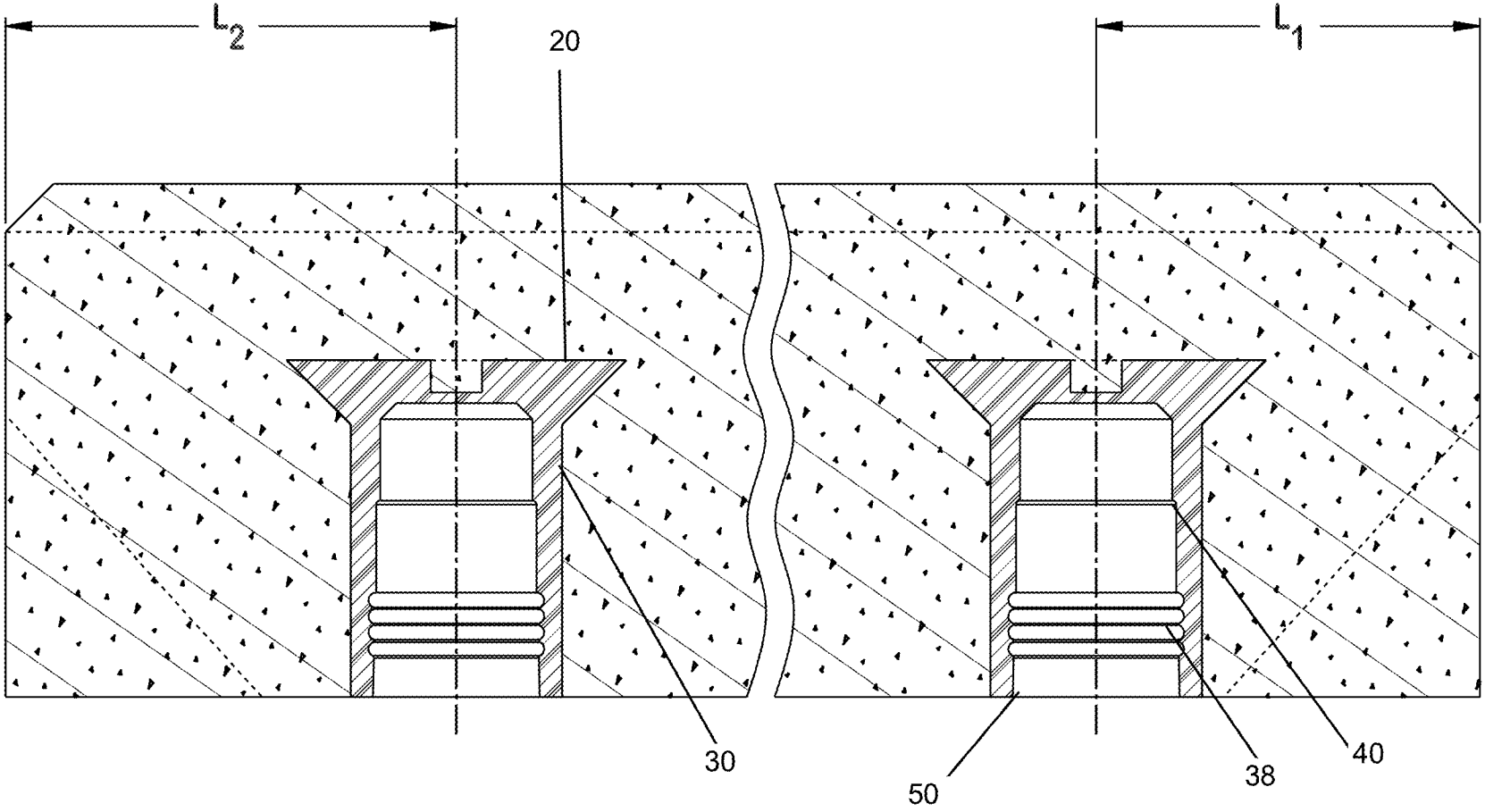
FIG. 68 illustrates another cross-sectional view.

As assembled and as shown in FIGS. 48-68, when a user is ready to utilize the locking mechanism assembly 1.

The perimeter of the locking mechanism 80 is positioned within the receiver 102 of the support mechanism 100. Specifically, the locking mechanism 80 abuts the upper portion 82*a* against the inner surface of the receiver 102. Simultaneously, the stopper 122 extends into the insert receiver 82 of the locking mechanism 80.

In the exemplary embodiment, the bottom surface of the locking mechanism 80 and the bottom surface of the support mechanism 100 abuts against the top plate 170.

In the exemplary embodiment, the tooling receiver 88 of the locking mechanism 80 aligns with the tooling receiver 114 of the support mechanism 100, specifically, the tooling receiver 88 is inserted within the tooling receiver 114, specifically into the passageway 116. The passageways 90 then permits an extension through both locking mechanism 80 and the support mechanism 100.

In the exemplary embodiment, the locking mechanism 80 provides a rotational movement within the receiver 102 while the stopper 122, 124 controls the amount of movement the locking mechanism may rotate. Specifically, in an unlocked state, the stopper 124 rests against a far wall of the lock position 86, while each stopper 122 rests in the central region of the insert receiver 82.

In the exemplary embodiment, the top insert 10 and the bottom insert 50 are coupled together. Specifically, the keyed portion 60 of the bottom insert 50 is positioned within the inner surface 34 of the top insert 10. The first rib 64 rests on the top ridge 38 of the plurality of ridges 36 while the second rib 66 rests above the ledge 40, securely coupling the top insert 10 to the bottom insert 50.

In the exemplary embodiment, the head portion 20 is coupled and positioned within the paver insert receiver 150 of the support member 140. The support member 140 is positioned on one of the quadrants 106. The side walls 146 abut against the walls 110 of the support mechanism 100.

In the exemplary embodiment, the assembled insert assembly 2 within the support member 140, is positioned within the unlock position 84 of the insert receiver 82. In the exemplary embodiment, a portion of the insert assembly 2 is positioned above the locking mechanism 80 and below the locking mechanism 80. Additionally, a portion of the insert assembly 2 is positioned above the support mechanism 100 and below the support mechanism 100.

In the exemplary embodiment, a user may control the locking mechanism 80 from an unlocked state to a locked state by rotating the locking mechanism 80. The user may utilize the locking tool T to control the rotation. The user will insert the end of the locking tool T into the passageway 90 of the locking mechanism 80 and rotate the locking mechanism 80 until the head portion 20 of the top insert 10 abuts against the protrusion 120 of the support mechanism 100 preventing further rotational movement of the locking mechanism 80 and securing the insert assembly to the locking assembly 4. When the user rotates the locking mechanism 80, the support mechanism 100 is stationary and is in a static state while the locking mechanism freely moves from an unlocked position to a locked position.

The above description is only for the specific embodiment of the present invention and is not intended to limit the scope of the present invention. The equivalent changes or modifications made by the structures, features and principles of the present invention should be included in Within the scope of the patent application of the present invention.

What is claimed is:

1. A locking mechanism pedestal assembly comprising:
- a support mechanism;
- a locking mechanism with a passageway and insert receivers positioned around the passageway and within the support mechanism;
- an insert assembly positioned through the support mechanism and the locking mechanism; and
- a pedestal, the support mechanism and the locking mechanism abut against a portion of a top surface of the pedestal, wherein the support mechanism and the locking mechanism are not connected to the top surface of the pedestal by the insert assembly.

2. The locking mechanism pedestal assembly of claim 1, wherein the pedestal on a first face is positioned against the support mechanism and locking mechanism on a second face.

3. The locking mechanism assembly of claim 1, wherein the insert assembly includes a top insert and a bottom insert.

4. The locking mechanism assembly of claim 3, wherein the top insert includes a head portion and a neck portion extending from the head portion.

5. The locking mechanism assembly of claim 4, wherein the neck portion includes a plurality of ridges on an inner surface of the neck portion.

6. The locking mechanism assembly of claim 5, wherein neck portion includes a plurality of tight ridges and a plurality of loose ridges.

7. The locking mechanism assembly of claim 6, wherein the bottom insert includes a base portion and a keyed portion.

8. The locking mechanism assembly of claim 7, wherein the keyed portion includes a plurality of ledges positioned on an outer surface of the keyed portion.

9. The locking mechanism assembly of claim 8, wherein the plurality of ledges includes a first ledge and a second ledge.

10. The locking mechanism assembly of claim 9, wherein the second ledge has a circumference less than a circumference of the first ledge.

11. The locking mechanism assembly of claim 10, wherein the support mechanism further includes a plurality of stoppers positioned on a bottom surface of the support mechanism.

12. A locking mechanism pedestal assembly comprising:
- a circular support mechanism having a circular receiver within the support mechanism;
- a locking mechanism with a passageway and insert receivers positioned around the passageway and within the circular receiver of the support mechanism;
- an insert assembly positioned through the support mechanism and the locking mechanism; and
- a pedestal, the support mechanism and the locking mechanism abut against a portion of a top surface of the pedestal, wherein the support mechanism and the locking mechanism are not connected to the top surface of the pedestal by the insert assembly.

13. The locking mechanism pedestal assembly of claim 12, wherein the pedestal includes a top plate.

14. The locking mechanism pedestal assembly of claim 13, wherein a plate extender extends from a bottom portion of the top plate.

15. The locking mechanism pedestal assembly of claim 14, wherein the pedestal further includes a pedestal column.

16. A locking mechanism pedestal assembly comprising:
- a support mechanism which includes a plurality of stoppers positioned on a bottom surface of the support mechanism;
- a locking mechanism positioned within the support mechanism;
- an insert assembly positioned through the support mechanism and the locking mechanism, wherein the insert assembly includes:
  - a top insert that includes a head portion and a neck portion extending from the head portion, wherein the neck portion includes a plurality of tight ridges and a plurality of loose ridges on an inner surface of the neck portion; and
  - a bottom insert that includes a base portion and a keyed portion that includes a plurality of ledges positioned on an outer surface of the keyed portion, wherein the plurality of ledges includes a first ledge and a second ledge that has a circumference less than a circumference of the first ledge; and
- a pedestal, the support mechanism and the locking mechanism abut against a top of the pedestal.

* * * * *